US010927619B1

(12) United States Patent
Anthony

(10) Patent No.: US 10,927,619 B1
(45) Date of Patent: Feb. 23, 2021

(54) METHOD AND APPARATUS FOR CONTAINMENT AND COLLECTION OF FLUIDS

(71) Applicant: Ted M. Anthony, Lafayette, LA (US)

(72) Inventor: Ted M. Anthony, Lafayette, LA (US)

(73) Assignee: EABA CONSULTING, L.L.C., Lafayette, LA (US)

( * ) Notice: Subject to any disclaimer, the term of this patent is extended or adjusted under 35 U.S.C. 154(b) by 51 days.

(21) Appl. No.: 16/400,589

(22) Filed: May 1, 2019

Related U.S. Application Data

(60) Provisional application No. 62/665,158, filed on May 1, 2018.

(51) Int. Cl.
*E21B 21/01* (2006.01)
*E21B 19/16* (2006.01)

(52) U.S. Cl.
CPC ..... *E21B 21/01* (2013.01); *E21B 19/16* (2013.01)

(58) Field of Classification Search
CPC ..... E21B 19/16; E21B 21/01
See application file for complete search history.

(56) References Cited

U.S. PATENT DOCUMENTS 2,068,665 A * 1/1937 Douglass ..... E21B 21/01 166/81.1
2011/0265992 A1* 11/2011 Pearson ..... E21B 21/01 166/267

* cited by examiner

*Primary Examiner* — Brad Harcourt
(74) *Attorney, Agent, or Firm* — Ted M. Anthony

(57) ABSTRACT

A fluid containment device has a sleeve-like housing defining an inner chamber and an elongate slot or opening. At least one inner door is received in the inner chamber, and can rotate between a first retracted position (leaving the elongate slot open or unobstructed) and a second position (causing the elongate slot to be blocked or obstructed). With the inner door in the retracted position, the device can be quickly and efficiently positioned around a threaded connection existing between adjacent pipe sections. A safety door prevents undesired placement of body parts or other objects in the elongate slot (and in the path of the inner door) during powered rotation of the inner door. A variable diameter seal assembly is selectively closed around the outer surface of any pipe sections. The device prevents drilling fluid from uncontrolled splashing or spilling on personnel or the surrounding environment upon separation of the pipe sections, while also saving and redirecting the drilling fluid to a rig's mud system for further handling.

13 Claims, 17 Drawing Sheets

METHOD AND APPARATUS FOR CONTAINMENT AND COLLECTION OF FLUIDS

CROSS REFERENCES TO RELATED APPLICATION

PRIORITY OF U.S. PROVISIONAL PATENT APPLICATION Ser. No. 62/665,158, FILED May 1, 2018, INCORPORATED HEREIN BY REFERENCE, IS HEREBY CLAIMED.

STATEMENTS AS TO THE RIGHTS TO THE INVENTION MADE UNDER FEDERALLY SPONSORED RESEARCH AND DEVELOPMENT

NONE

UNITED STATES PROVISIONAL PATENT APPLICATION

BACKGROUND OF THE INVENTION

1. Field of the Invention

The present invention pertains to a fluid containment apparatus, (commonly referred to as a "mud bucket") for preventing uncontrolled spray and/or spillage of fluids when joined sections of pipe are separated on a drilling rig. More particularly, the present invention pertains to a lightweight and compact hinge-less mud bucket that can be quickly, efficiently and safely positioned around connected pipe sections, and that selectively contains and collects fluids (such as, for example, drilling mud, completion fluids and/or additives) when adjacent pipe sections are separated.

2. Brief Description of the Prior Art

Drilling rigs typically comprise a supportive rig floor, a derrick that extends in a substantially vertical direction above said rig floor, and a lifting device that can be raised and lowered within said derrick. Generally, such drilling rigs are positioned over a wellbore that extends into subterranean strata. During drilling operations, said drilling rig and associated equipment can be used to manipulate and move tubular goods (including, without limitation, drill pipe, casing and/or other tubular) into and out of a wellbore. For example, drill bits and/or other down hole equipment are typically conveyed into a wellbore and maneuvered within said wellbore using a tubular work string comprising a plurality of individual joints of drill pipe. Such individual joints are threadably connected to one another in end-to-end relationship until a string having a desired length is formed.

Various fluids, commonly referred to as drilling mud and/or drilling fluids, are often pumped into a through-bore of said tubular goods during well drilling and/or completion operations, and are then circulated back to the earth's surface. Additives and chemicals are frequently added to drilling mud in order to provide or adjust the various characteristics and/or performance of such drilling mud. Exposure to said drilling mud, with or without additives, can be harmful to rig personnel; drilling mud and/or additives can frequently cause allergic skin reactions and other health problems. Additionally, said drilling mud and additives can be environmentally hazardous and, in some cases, can be extremely expensive. As a result, it is generally desirable to contain said drilling fluids and to prevent said drilling fluids from spraying, splashing, spilling and/or otherwise contacting personnel and drilling rig equipment that is not part of the mud system.

When removing a string of pipe from a wellbore (such as, for example, in order to remove and change a drill bit or other equipment located at the bottom or distal end of the drill string)—a process commonly referred to as "tripping out of the well"—a threaded pipe string is removed from the well one or more sections at a time. During such operations, the upper end of the drill string is lifted within a drilling rig derrick until a threaded connection between two joints of drill pipe is positioned a desired distance above a rig floor—typically a distance wherein said threaded connection can be conveniently accessed by personnel working on a drill floor. Thereafter, the entire pipe string is suspended or hung in place at the rig floor using a device commonly known as "slips".

After the slips have been set, the threaded connection positioned above the rig floor can then be "broken-out" or loosened by tongs or other similar means. Thereafter, the uppermost section(s) of pipe can be completely unscrewed (typically via rotation of said uppermost pipe section(s), removed from the drill string and stored within the derrick or on a pipe rack. The process can be repeated numerous times until a desired length of pipe is removed from said wellbore and disconnected from said pipe string.

In many cases, some amount of drilling mud can remain in the central bore of at least some of the pipe lifted out of a well and suspended within the derrick. As a result, a significant volume of drilling mud contained within such pipe bore can leak out during separation of two adjacent pipe sections at a threaded pipe connection; depending on the height of the fluid column, said fluid in said pipe bore can exert significant hydrostatic pressure at said threaded piped connection at or near the rig floor. Such drilling mud can spray radially outward from the separated pipe sections (typically due to the hydrostatic fluid head from fluid contained in an upper pipe section), splash on personnel, getting into their eyes and/or coming in contact with their skin. Further, the drilling mud can also spill into the surrounding environment. Drilling mud on a rig floor or other surfaces can also create a slipping hazard to rig personnel.

Attempts have been made to solve the problem of controlling the spilling of drilling fluids during separation of a threaded connection using a device commonly referred to as "mud bucket". Generally, such mud buckets comprise a substantially cylindrical-shaped container fabricated by splitting or cutting a length of a relatively large diameter pipe along a mid-plane extending through its longitudinal axis, thereby creating two substantially semi-cylindrical halves of roughly equal size. Said two halves are hingedly connected along one long side using at least one hinge assembly, and can include a latching or locking mechanism generally opposite said hinge hinging assembly.

During use, a conventional mud bucket is typically suspended (usually from a cable or other arrangement) a desired distance above a drilling rig floor, spread apart about said hinge(s) into an open position, and moved laterally into position toward the suspended pipe. Thereafter, the mud bucket is closed about said hinge(s), causing the leading edges of the mud bucket to converge around a portion of the pipe in order to enclose a threaded connection (as well as a portion of adjacent pipe sections above and below said threaded connection). In this position, the mud bucket can then be latched or locked in a closed configuration around said pipe. In most cases, a mud bucket is positioned and secured in this manner after mating threads of a threaded connection have been "broken-out", but before said mating threads are completely disconnected and the adjoining pipe sections are separated, in order to ensure that any mud within the bore of the pipe remains contained until the mud bucket is secured around the pipe.

After the mud bucket has been positioned around the threaded connection and latched, the upper pipe section can be rotated to fully unscrew the male and female threaded connection members from each other. Thereafter, said upper pipe section can be axially lifted some distance in order to fully detach and separate it from the lower pipe section. With the mud bucket secured in place surrounding said threaded connection, any drilling fluid flowing out of the disconnected upper pipe section can contained within an interior chamber formed by said mud bucket. Such mud is generally permitted to evacuate said chamber through a drainage hose connected to one or both semi-cylindrical half members of the mud bucket and, eventually, into a mud tank or other storage reservoir.

Conventional mud buckets can be simple mechanical devices that are operated by hand. However, in some cases, such hand-operated mud buckets cannot adequately handle high fluid pressures or large mud volumes encountered during drilling or other operations. As such, in certain case, such mud buckets can be automated using pneumatic or hydraulically actuated cylinders to selectively open and close said hinged members.

In most cases, conventional automated mud buckets frequently include an outer frame or other structure for supporting a pair of opposed and hingedly attached semi-cylindrical members, as well as fluid-powered cylinders and associated hoses, fittings and other equipment. Such conventional mud buckets (including said support frame members, associated fluid-powered cylinders and related equipment) can be large, bulky and heavy. Such conventional mud buckets can be difficult for personnel to maneuver and position, which can result in operational delays and injury risk. Further, such conventional mud buckets can take up a great deal of space (which can be problematic on many drilling rigs because available space can be at premium, especially on or around a drilling rig floor).

Perhaps most significantly, said conventional hinged mud buckets present a substantial risk to operating personnel when being closed around pipe, as hands, fingers and other body parts can inadvertently be positioned between said opposing semi-cylindrical members. In such cases, any hands, fingers and other body parts that are inadvertently caught between said opposing members can be smashed, severed or otherwise severely damaged.

Thus, there is a need for a fluid containment apparatus that is lighter and more compact than conventional mud buckets, thereby making it easier to maneuver and operate, and also more convenient to store during periods of non-use. Said fluid containment apparatus should also be safer than conventional mud buckets, effectively eliminating the risk of hands, fingers and other body parts being inadvertently caught or pinched between opposing members as said members are closed together.

SUMMARY OF THE INVENTION

The fluid containment apparatus of the present invention generally comprises a substantially cylindrical housing member or sleeve defining an upper end, a lower end and an inner chamber. A longitudinal keyway slot or opening is formed along the length of the housing member from said upper end to said lower end, and extends from the external surface of said housing member into said inner chamber. A removable cap can be installed on the upper end of said housing member using mechanical fasteners or other temporary but secure attachment means.

At least one fluid containment door is moveably mounted relative to said housing member. In a preferred embodiment, said at least fluid containment door is mounted within said inner chamber of said housing member, and can have an arcuate or partially cylindrical shape, with a radius of curvature smaller than that of said housing member. In an alternative embodiment, said at least one fluid containment door can have a partially cylindrical shape, with a radius of curvature larger than said housing member; in said alternative embodiment, said fluid containment door is mounted along the external or outer surface of said housing member. Said at least one fluid containment door can selectively rotate relative to said housing member about a central longitudinal axis that is coaxial (or parallel) to said central longitudinal axis of said housing member.

When said at least one fluid containment door is in a retracted or "open" position, said longitudinal keyway slot or opening is not obstructed, and a pathway is established from outside said housing member through said keyway opening into said inner chamber. However, when said at least one fluid containment door is in an un-retracted or "closed" position, said at least one fluid containment door blocks said opening, thereby effectively sealing said keyway opening of said housing member. When said at least one fluid containment door is an un-retracted or closed position, said housing member, cap and said at least one fluid containment door cooperate to form axially aligned central (typically circular) apertures extending through the upper and lower surfaces of said fluid containment apparatus, typically for receiving pipe sections.

At least one powered actuator can be used to selectively shift said at least one fluid containment door between a retracted position and an un-retracted position relative to said housing member. In a preferred embodiment, said powered actuator comprises a pneumatically powered rotary actuator having an output power shaft; said output power shaft is operationally attached to a drive sprocket. A drive rod having a drive sprocket and at least one ancillary sprocket is rotationally mounted along the exterior of said housing. A drive chain extends around said actuator drive sprocket and said rod drive sprocket; as such, torque forces from said output power shaft of said actuator can be selectively transferred by said drive chain to said drive sprocket of said actuator and, ultimately, to said drive sprocket of said drive rod.

At least one door drive chain is disposed around said at least one ancillary sprocket, and connected to said at least one fluid containment door. Actuation of said rotary actuator transfers torque forces to said elongate drive shaft which, in turn, causes said at least one ancillary sprocket to impart force to said at least one door drive chain. In this manner, said fluid containment door can be selectively shifted from a first open/retracted position to a second closed position, and vice versa.

In an alternative embodiment, said powered actuator comprises at least one air-powered pneumatic cylinder disposed on the outer surface of said housing member. At least one flexible shaft (such as, for example, a substantially incompressible push/pull cable or the like) is slidably disposed in a curved track that extends from a piston rod of said at least one pneumatic cylinder to said at least one inner sleeve. Extension of said pneumatic cylinder can cause said flexible shaft to push said at least one fluid containment door to a closed or un-retracted position, while retraction of said pneumatic cylinder can cause said flexible shaft to pull said at least one fluid containment door to an open or retracted position.

Elastomeric seal members selectively provide a fluid pressure seal between interfacing surfaces of said at least one fluid containment door and said housing when said at least one fluid containment door is in a closed or un-retracted position. Further, opposing elastomeric seal members provide fluid pressure seal(s) against the outer surface of a tubular member disposed in said fluid containment apparatus. In a preferred embodiment, said opposing elastomeric seal members can form a fluid pressure seal against the external surface of a pipe section disposed within said fluid containment apparatus, and can automatically adjust to seal against pipes having different (variable) outer diameters.

A recessed area or sump basin is formed by the bottom of said housing. Any drilling mud or other fluid released within said inner chamber when said at least one fluid containment door is in an un-retracted or closed position can flow into said basin and remain there until flowing out of a drain port; such fluid in said sump basin will not leak or escape from said inner chamber in an uncontrolled manner upon shifting of said at least one fluid containment door to an open position.

At least one optional baffle member is disposed along the inner surfaces of said at least one fluid containment door and generally slope toward said sump basin. Said at least one baffle member(s) act to block upward flow and dissipate released fluid pressure when opposing pipe sections are separated. Further, any fluids released within the inner chamber of said fluid containment apparatus that splash on said baffle member(s) can be directed or run off toward said sump basin, but will not be released outside of said fluid containment apparatus when said at least one fluid containment door member is shifted to an open or retracted position.

A manual gate or safety door can be optionally installed on said housing in order to selectively block access to said keyway opening, particularly when said fluid containment door is in an open or partially open position. In a preferred embodiment said gate can be connected to a switch to prevent the flow of operating power fluid (air or hydraulic oil) to a powered actuator unless said gate is closed; in this manner, said gate can serve as a safety device to prevent personnel from inadvertently placing hands, fingers or other body parts in said keyway opening of said housing member and having them crushed or otherwise damaged when said at least one fluid containment door is shifted, especially to a closed position.

In operation, said fluid containment apparatus of the present invention is typically suspended or hung within a drilling rig derrick in relatively close proximity to a threaded pipe connection. Said manual gate or safety door can be opened with said at least one fluid containment door in a first open position. With said manual gate or safety door open, and said at least one fluid containment door in said first (open) position, the keyway opening is unobstructed and provides access to said inner chamber of said fluid containment apparatus.

In this configuration, said fluid containment apparatus can be quickly and efficiently positioned about a threaded pipe connection existing between adjacent joined pipe sections, typically positioned a desired distance above a rig floor. More specifically, said pipe sections pass through said unobstructed keyway opening until said pipe sections are received within the inner chamber of the fluid containment apparatus. Further, with said safety door in an open position, the supply of operating power fluid (air or hydraulic oil) to an actuation device is selectively blocked, thereby preventing functioning of said actuation device and inadvertent/accidental closing of said at least one fluid containment door.

After said fluid containment apparatus is positioned about a threaded connection existing between adjacent pipe sections (typically positioned a desired distance above a rig floor), said manual safety door can be closed and latched or otherwise secured in a closed position, thereby triggering said switch and permitting supply of operating power fluid (air or hydraulic oil) to an actuation device. With said safety gate closed, said at least one fluid containment door can be shifted to a second closed position. Said closed manual safety door prevents personnel from inadvertently placing hands, fingers or other body parts in said keyway opening of said housing member and having them pinched, crushed or otherwise damaged when said at least one fluid containment door member is shifted or rotated, especially to a closed position.

In this configuration, said housing member, cap, at least one fluid containment door and any seal members cooperate to form axially aligned central (typically circular) apertures that surround and seal against the outer surface of pipe sections contained therein. The fluid containment apparatus effectively surrounds the threaded pipe connection, which is disposed within the inner chamber thereof. Said adjoining sections of pipe can be separated (typically by lifting of an upper pipe section away from a lower pipe section); during such separation, the fluid containment apparatus contains, diverts and collects drilling fluid in the inner chamber thereof, thereby preventing drilling fluid from uncontrolled spraying, splashing or spilling on a nearby rig floor, personnel and/or surrounding environment.

Thereafter, with said manual gate or safety door still in a closed position, operating power fluid remains supplied to an actuation device, thereby allowing said at least one fluid containment door to be selectively shifted back to said a first open or retracted position (thereby substantially exposing said keyway opening). Said safety door can then be opened, once again blocking the flow of operating power fluid to said actuation device; in this configuration (with the safety door in the open position and operating power fluid blocked) the actuation device will not operate and said at least one fluid containment door cannot be inadvertently or accidentally closed. With said at least fluid containment door (and safety door) open, said fluid containment apparatus can be quickly and efficiently moved away from the separated pipe section to a stand-by position. Thereafter, the process can be repeated.

BRIEF DESCRIPTION OF THE ANNOTATED DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
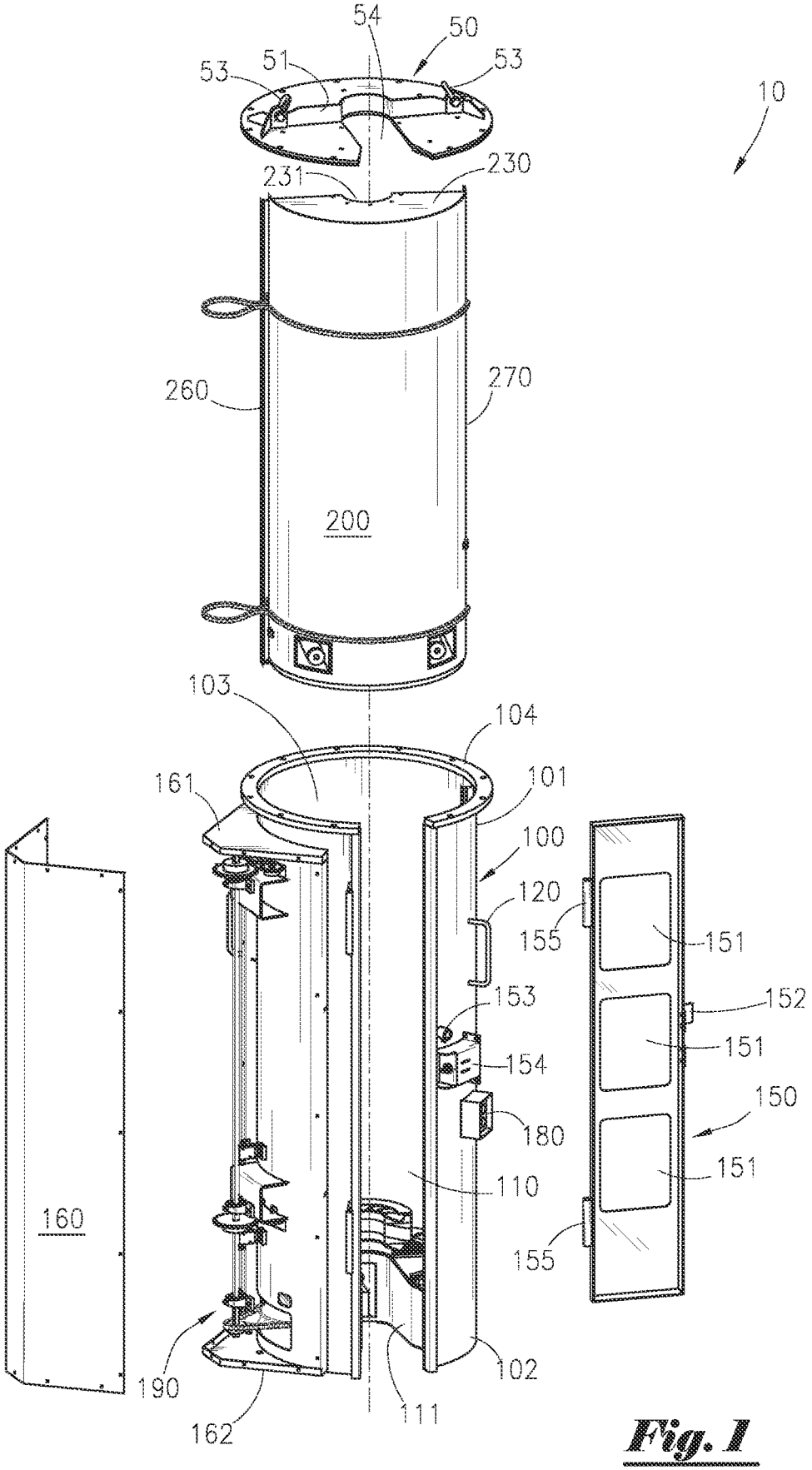
FIG. 1 depicts a perspective exploded view of the fluid containment apparatus of the present invention.

Referring to the drawings, FIG. 1 depicts a perspective exploded view of fluid containment apparatus 10 of the present invention. Said fluid containment apparatus 10 generally comprises a substantially cylindrical housing or sleeve 100 defining an upper end 101, a lower end 102 and an inner void space or chamber 103. A connection flange 104 is disposed at said upper end. A longitudinal keyway slot or opening 110 is formed along the length of said housing 100 and extends from said upper end 101 to said lower end 102 and, further, extends from the external surface of said housing member 100 into said inner chamber 103. U-shaped guide member 111 extends from keyway opening 110 into inner chamber 103.

A cap 50 can be removably installed on connection flange 104 at upper end 101 of said housing 100. In a preferred embodiment, said cap 50 is substantially circular, and can include support rib 51 to provide strength to said cap 50, as well as U-shaped slot 54 that extends from an outer circumferential edge of said cap 50 to substantially said mid-point of said cap 50. U-shaped guide member 111 is substantially aligned (and in parallel relationship) with U-shaped slot 54 of cap member 50. Further, said cap 50 can include eyelets for receiving shackles 53, which can be used to connect assembled fluid containment apparatus 10 to a hoist or other lifting device, thereby allowing said fluid containment apparatus 10 to be suspended within a drilling rig derrick or other location a desired distance off of a rig floor other underlying support surface.

At least one movable fluid containment door 200 is received, and rotatably disposed, within inner chamber 103 of housing 100. In a preferred embodiment, said at least one fluid containment door 200 has an arcuate or partial cylindrical shape (such as semi-cylindrical shape), with a radius of curvature smaller than said housing 100. Said fluid containment door 200 has substantially planar upper member 230 and a substantially semi-cylindrical body section. Said body section has leading edge 270 and trailing seal surface 260, which can be a flange-like extension. Upper member 230 has semi-circular recess 231. An actuation assembly 190 is operationally mounted to an outer surface of housing 100. A removable actuation assembly cover 160 can be installed over said actuation assembly 190 between cover top 161 and bottom 162; said cover 160 can beneficially block access to said actuation assembly 190, but can be selectively removed when desired.

A manual gate or safety door 150 can be moveably attached to housing 100 in order to selectively block access to said keyway opening 110 of housing 100, particularly when said fluid containment door 200 is in a full or partially open position. In a preferred embodiment safety door 150 is has at least one aperture or opening 151, and is hingedly mounted to housing 100 using hinges 155. Although not depicted in FIG. 1, mesh, grating or other substantially transparent material can be installed within said at least one aperture 151 in order to allow visual observation through said at least one aperture 151 (such as to visually confirm positioning of movable fluid containment door 200), while simultaneously preventing extremities (hands, fingers, arms, legs, feet or other body parts) from passing through said at least one aperture 151 into keyway opening 110.

Figure 2:
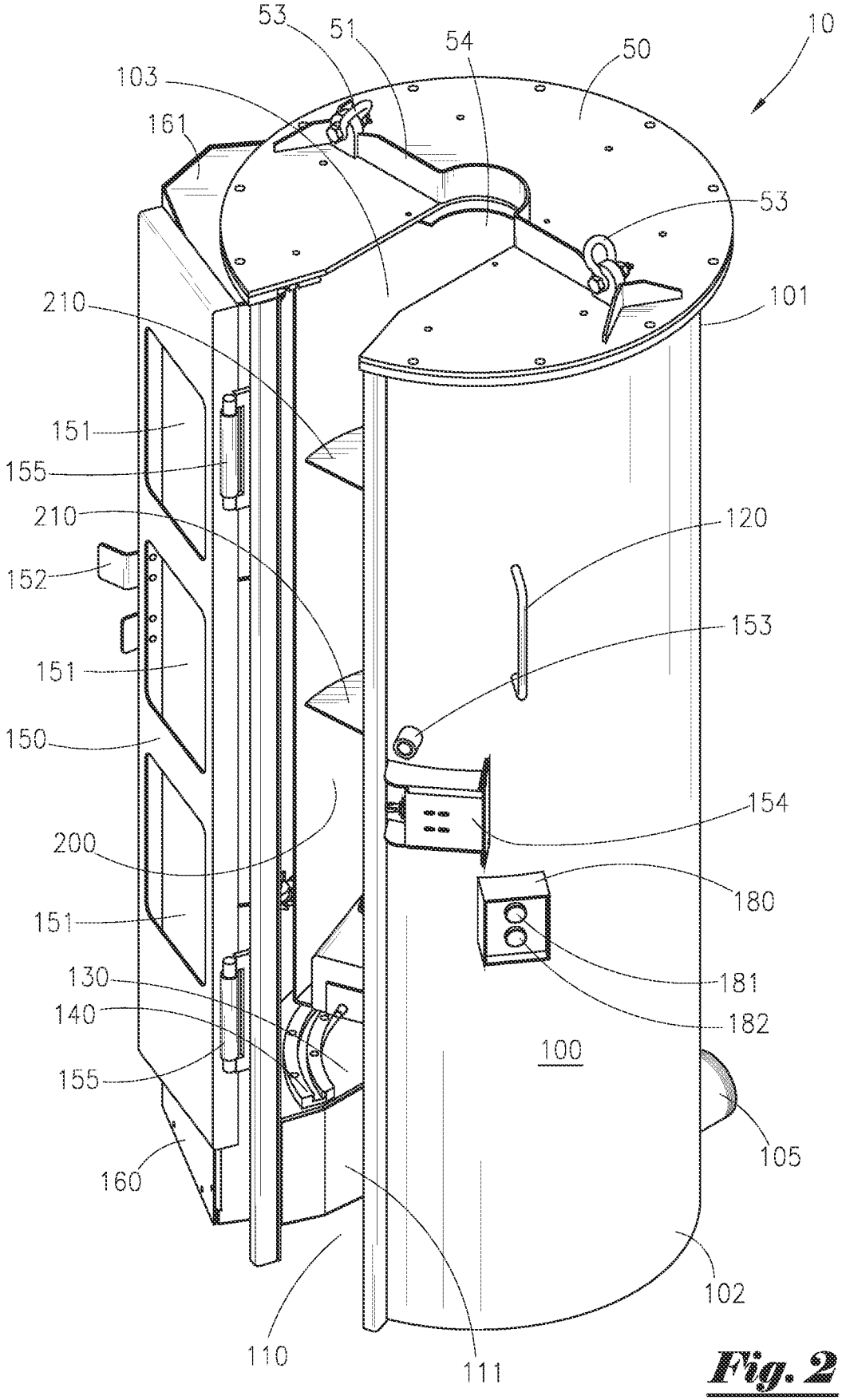
FIG. 2 depicts a side perspective view of the fluid containment apparatus of the present invention in a fully open configuration.

FIG. 2 depicts a side perspective view of fluid containment apparatus 10 of the present invention in a fully open configuration. Said fluid containment apparatus 10 generally comprises a substantially cylindrical housing or sleeve 100 defining an upper end 101, a lower end 102 and an inner void space or chamber 103. Longitudinal keyway opening 110 is formed along the length of said housing 100 and extends from said upper end 101 to said lower end 102 and, further, from the external surface of housing member 100 to said inner chamber 103 thereof.

Door support base 130 is disposed within said inner chamber 103 and is oriented substantially perpendicular to the longitudinal axis of housing 100. A curved or arcuate track 140 is disposed on said door support base 130; in a preferred embodiment, said arcuate track 140 is disposed on both lateral sides of keyway opening 110. Said track 140 can be beneficially constructed of ultrahigh molecular weight (UHMW) polyethylene or other material exhibiting desired characteristics of durability, low friction and high lubricity. U-shaped guide member 111 extends from keyway opening 110 into inner chamber 103, and is substantially aligned (and in parallel relationship) with U-shaped slot 54 of cap member 50.

At least one movable fluid containment door 200 is rotatably disposed within inner chamber 103 of housing 100; at least one extension along the lower surface said fluid containment door 200 is disposed within curved track 140. In a preferred embodiment, said at least one fluid containment door 200 has an arcuate or partial cylindrical shape, with a radius of curvature smaller than said housing 100. Said at least one fluid containment door 200 can rotate along the path of track 140 from a first position, wherein said at least one fluid containment door 200 is not blocking or obstructing said keyway opening 110, to a second position, wherein said at least one fluid containment door 200 is blocking or substantially obstructing said keyway opening 110. At least one optional baffle member 210 is disposed along the inner surface(s) of said at least one fluid containment door 200.

Manual safety door 150 is hingedly attached to housing 100 using hinges 155. Safety door 150 has at least one aperture or opening 151; although not depicted in FIG. 2, wire mesh, screen or similar material can be installed within said at least one aperture 151 to allow visual observation through said at least one aperture 151, while simultaneously preventing extremities (hands, fingers, arms, legs or feet) or other body parts from passing through said at least one aperture 151.

Cap 50 can be removably installed on connection flange 104 at upper end 101 of said housing 100. In a preferred embodiment, said cap 50 is substantially circular, and can include support rib 51 to provide strength to said cap 50, as well as U-shaped slot 54 that extends from an outer circumferential edge of said cap 50 to substantially said mid-point of said cap 50. Further, said cap 50 can include eyelets for receiving shackles 53, which can be used to connect assembled fluid containment apparatus 10 to a hoist or other lifting device, thereby allowing said fluid containment apparatus 10 to be suspended within a drilling rig derrick or other location a desired distance off of a rig floor other underlying support surface.

Still referring to FIG. 2, safety door 150 can further comprise latch member 152. Magnet 153 is disposed along the exterior surface of housing 100, and can be positioned so that said magnet 153 is aligned with latch member 152 on safety door 150 when said safety door 150 is in a closed position; in a preferred embodiment, said magnet can be pneumatically activated. Alternatively, safety door 150 can be equipped with conventional mechanical latch(es) to keep safety door 150 in a closed or an open position. Additionally, pneumatic switch 154 and control panel 180 having "open" control button 181 and "close" control button 182 can be disposed on housing 100.

Figure 3:
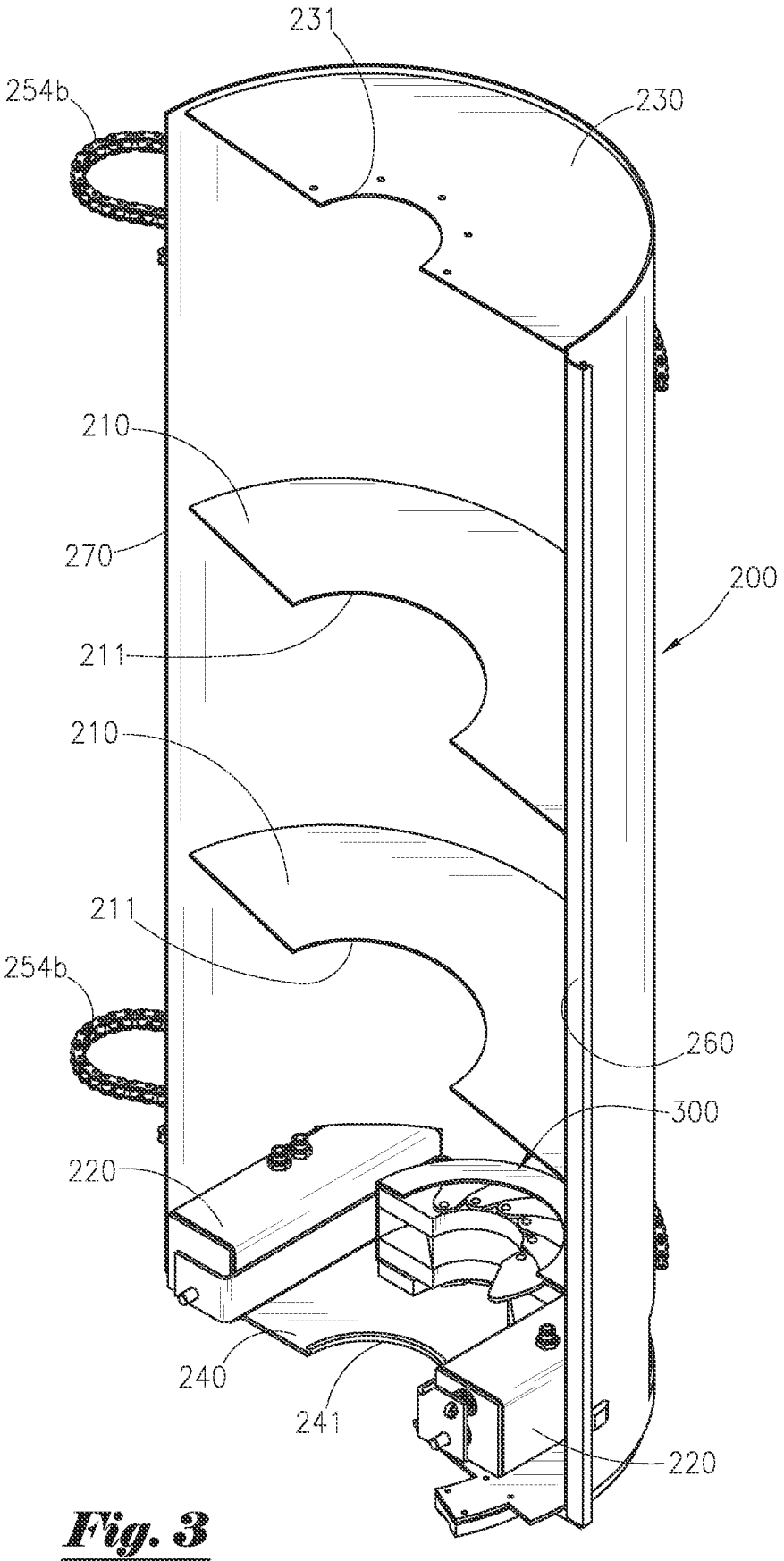
FIG. 3 depicts a front perspective view of a fluid containment door of the present invention.

FIG. 3 depicts a front perspective view of fluid containment door 200 of the present invention removed from housing 100. In the embodiment depicted in FIG. 3, said fluid containment door 200 has substantially planar upper member 230 and substantially planar lower base member 240, and a substantially semi-cylindrical body section positioned there between. Said body section has leading edge 270 and trailing and flange-like seal surface 260. Said upper member 230 and lower member 240 are oriented substantially parallel to each other. Upper member 230 has semi-circular recess 231, while lower base member 240 has semi-circular recess 241; said upper recess 231 and lower recess 241 are aligned.

At least one optional baffle member 210 is disposed along the inner surface(s) of said at least one fluid containment door 200. Each of said at least one baffle member 200 has curved recess 211 (which can be beneficially sized to be only slightly larger than the largest outer diameter of a pipe section contained within fluid containment apparatus 10) and can generally slope in a side to side downward orientation.

Still referring to FIG. 3, actuator housings 220 are disposed on or near lower base member 240. Further, said actuator housings 220 are oriented substantially parallel to each other in spaced-apart relationship. Movable seal assembly 300 is disposed on or along the upper surface of base 240, and is generally disposed between said parallel actuator housings 220.

Figure 4:
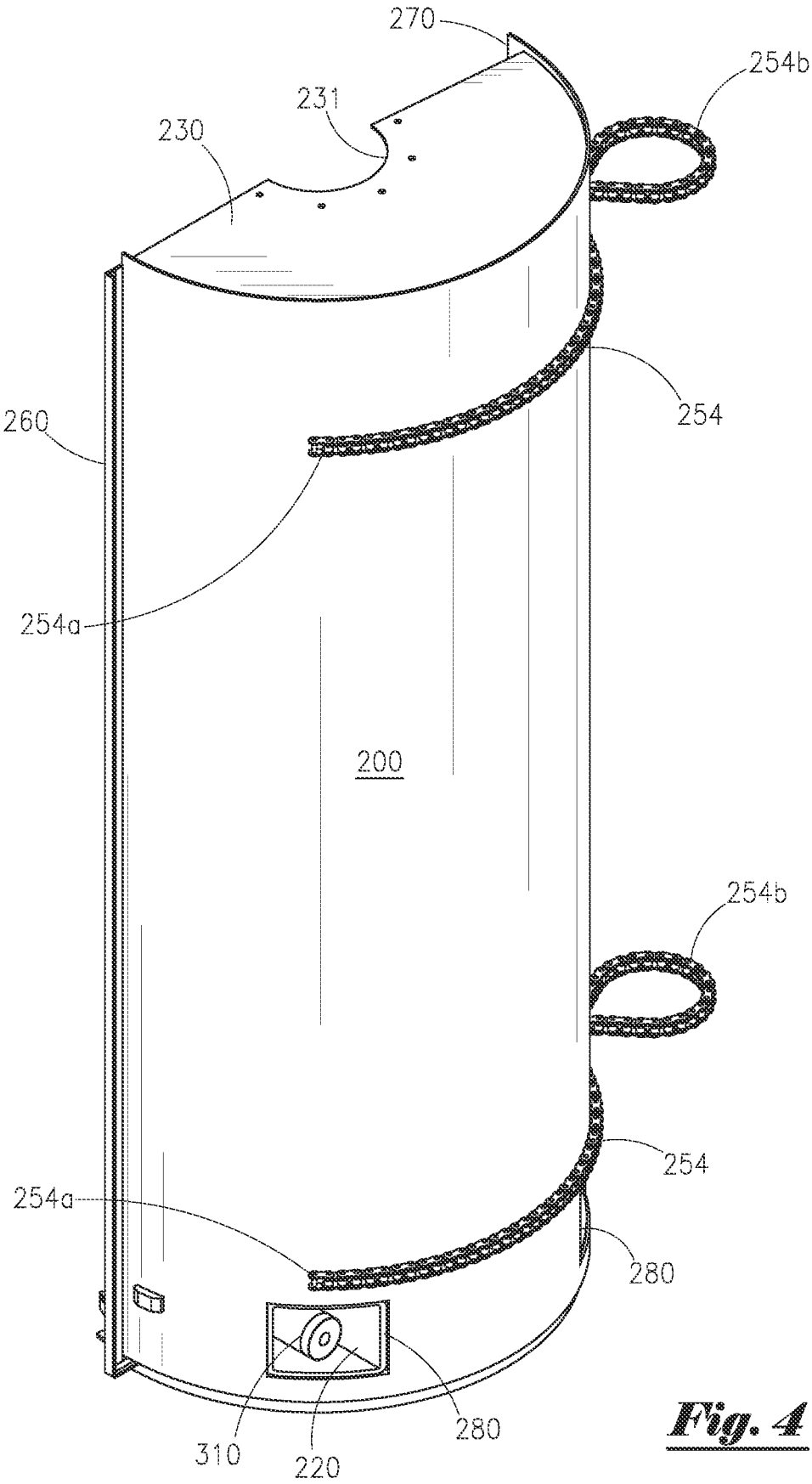
FIG. 4 depicts a rear perspective view of a fluid containment door of the present invention.

FIG. 4 depicts a rear perspective view of fluid containment door 200 of the present invention. Fluid containment door 200 has substantially planar upper member 230 and substantially planar lower base member 240 (not visible in FIG. 4) and a substantially semi-cylindrical body section positioned there between defining leading edge 270 and trailing seal surface 260. Upper member 230 has semi-circular recess 231. Actuator access apertures 280 correspond to actuator housings 220 and permit access to inner portions of said actuator housings 220. As described in detail below, a fluid powered cylinder (linear actuator) 310 is disposed within each actuator housing 220. Each actuator access aperture 280 permits access to an actuator housing 220 and a fluid powered cylinder 310 contained therein.

At least one door drive chain 254 is disposed along the outer surface of door 200. Each of said at least one door drive chains 254 is secured to door 200 at end **254*a* (and, although not visible in FIG. 4, is also secured to door 200 at or near leading edge 270), and is oriented substantially perpendicularly to the longitudinal axis of said door 200. Further, each of said at least one door drive chain 254 forms a loop 254*b*** that can be received on a corresponding sprocket.

Figure 5:
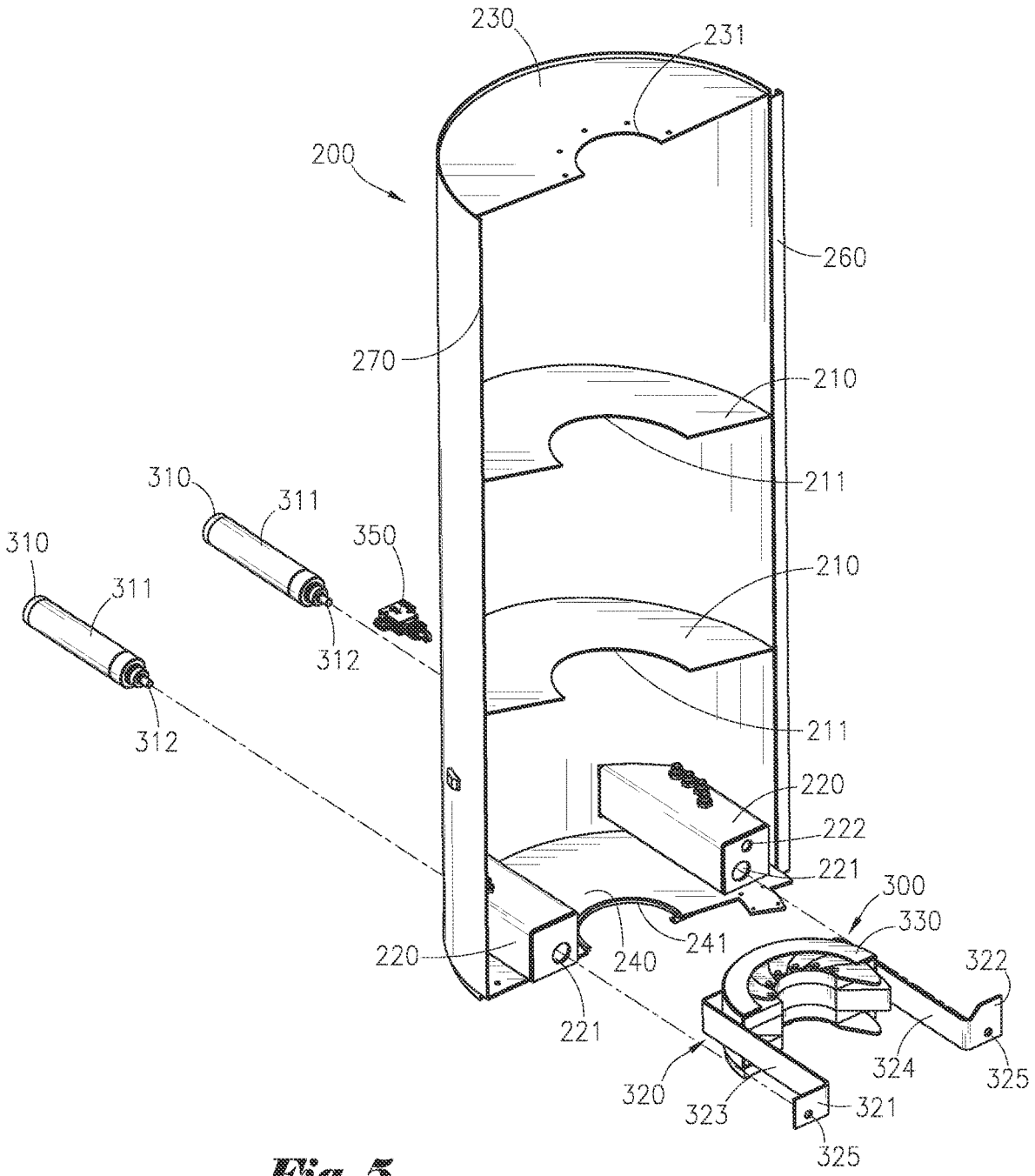
FIG. 5 depicts a front perspective and exploded view of a fluid containment door of the present invention.

FIG. 5 depicts a front exploded perspective view of a fluid containment door 200 of the present invention. Said fluid containment door 200 has substantially planar top member 230 and substantially planar lower base member 240, and a substantially semi-cylindrical body section positioned there between. Said body section defines leading edge 270 and trailing flange-like seal surface 260, while said upper member 230 and lower member 240 are oriented substantially parallel to each other. Upper member 230 has semi-circular recess 231, while lower base member 240 has semi-circular recess 241; said recesses 231 and 241 are aligned with each other.

At least one optional baffle member 210 is disposed along the inner surface(s) of said at least one fluid containment door 200. Each of said at least one baffle member 200 has curved recess 211 and generally slopes in a side to side downward orientation. Substantially parallel actuator housings 220 are disposed on or near lower base member 240. A fluid powered cylinder (linear actuator) 310 is disposed within each actuator housing 220. Each fluid powered cylinder 310 generally comprises a barrel 311 and piston rod 312 that can be selectively extended or retracted relative to said barrel 311; when installed within an actuator housing 220, a barrel 311 remains substantially sealed from drilling mud or other fluids, while a piston rod 312 can extend or retract through an aperture 221 in each aperture housing 220.

A movable seal assembly 300 is slidably disposed along the upper surface of base 240. Said movable seal assembly generally comprises seal carrier housing 330 attached to seal carrier yoke 320. Said seal carrier yoke 320 has first extension arm 323 which, in turn, has planar flange member 321 disposed at its distal end. Similarly, said seal carrier yoke 320 also has second extension arm 324 that is oriented substantially parallel to first extension arm 323, and has planar flange member 322 disposed at its distal end. Flange members 321 and 322 each have apertures 325 for connecting said flanges to a piston rod 312 of a fluid powered cylinder 310. In a preferred embodiment, pressure switch 350 is mounted in an actuator housing 220, and can partially extend through aperture 222; said pressure switch 350 can be contacted by flange member 322 (and, more specifically, extended flange section 322*a*) when seal carrier yoke 320 is in a retracted position.

Figure 6:
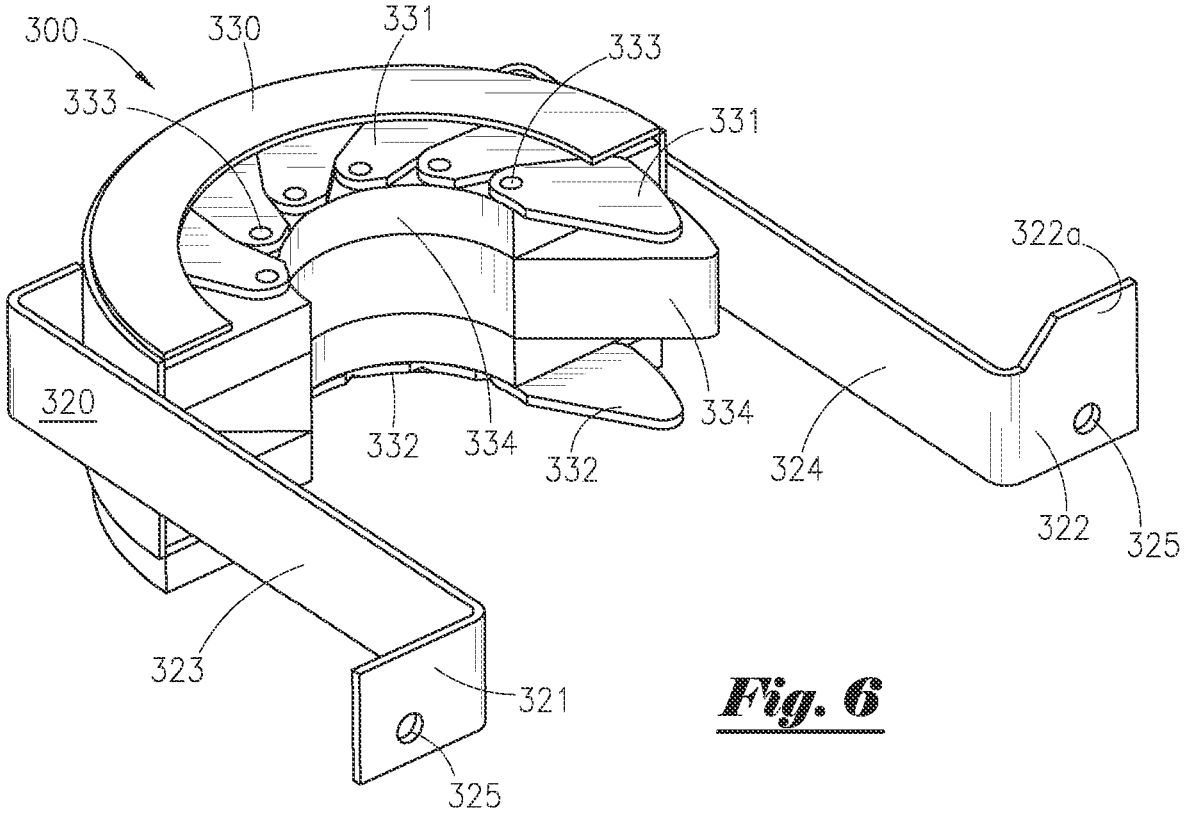
FIG. 6 depicts a side perspective view of a movable variable seal member of the present invention.

FIG. 6 depicts a side perspective view of a movable variable seal assembly 300 of the present invention. Said movable variable seal assembly 300 generally comprises seal carrier housing 330 attached to seal carrier yoke 320. Said seal carrier yoke 320 has first extension arm 323 which, in turn, has planar flange member 321 disposed at its distal end. Similarly, said seal carrier yoke 320 also has second extension arm 324 that is oriented substantially parallel to first extension arm 323, and has planar flange member 322 disposed at its distal end. Flange members 321 and 322 each have apertures 325 for connecting to a piston rod 312 of a fluid powered cylinder 310 (not pictured in FIG. 6).

Still referring to FIG. 6, a plurality of substantially wedge-shaped upper variable seal members 331 and substantially wedge-shaped lower variable seal members 332 are slidably received within semi-cylindrical seal carrier housing 330. In a preferred embodiment, said upper variable seal members 331 and lower variable seal members 332 are oriented substantially parallel to each other in corresponding pairs, with each respective pair joined together in spaced relationship using a connector rod 333. At least one elastomeric sealing member 334 is disposed in the space or gap formed between upper variable seal members 331 and lower variable seal members 332.

Figure 7:
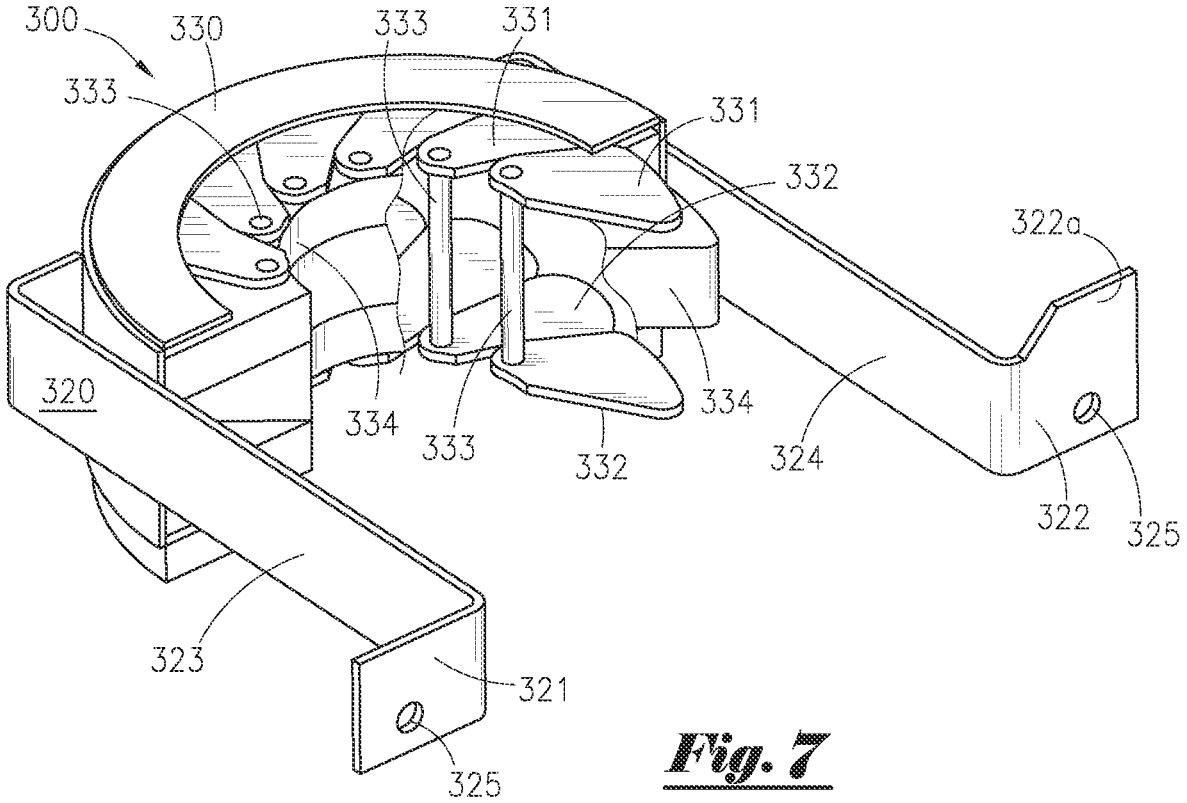
FIG. 7 depicts a side perspective and partial cut-away view of a movable variable seal member of the present invention.

FIG. 7 depicts a side perspective and partial cut-away view of a movable variable seal assembly 300 of the present invention. As noted above, said upper variable seal members 331 and lower variable seal members 332 are oriented substantially parallel to each other in corresponding pairs, with each respective pair joined in spaced apart relationship using a connector rod 333. At least one elastomeric sealing member 334 is disposed in the space or gap formed between said upper variable seal members 331 and lower variable seal members 332. Although not depicted in FIG. 7, said connector rods 333 can be received through bores formed in said elastomeric sealing member 334; said elastomeric sealing member 334 has sufficient flexibility that it can "follow" movement of said connector rods 333 as more fully described below.

Figure 8:
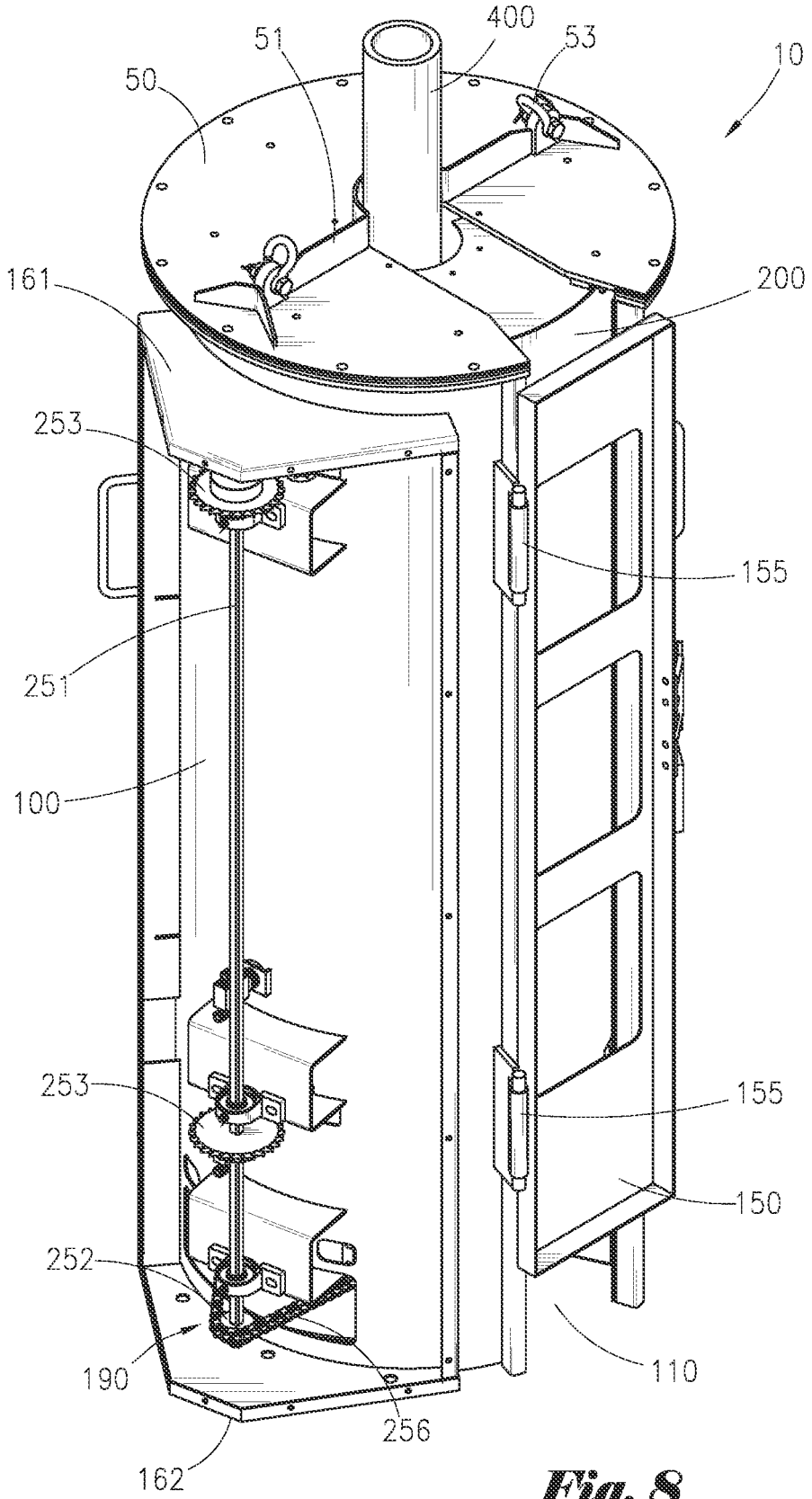
FIG. 8 depicts a side perspective view of the fluid containment apparatus of the present invention in a fully closed configuration, with fluid containment door actuation assembly exposed.

FIG. 8 depicts a side perspective view of fluid containment apparatus 10 of the present invention in a fully closed configuration, with actuator assembly cover 160 removed and actuation assembly 190 exposed. At least one powered actuator 250 (not visible in FIG. 8) can be used to selectively shift said at least one fluid containment door 200 between a retracted position and an un-retracted position relative to said housing member 100. In a preferred embodiment, said powered actuator comprises a pneumatically powered rotary actuator having an output power shaft; said output power shaft is operationally attached to a drive sprocket. A drive rod 251 having a rod drive sprocket 252 and at least one ancillary sprocket 253 is rotationally mounted along the exterior of housing 100. Drive chain 256 extends around said actuator drive sprocket 258 and rod drive sprocket 252; as such, torque forces generated by an output power shaft of said powered actuator are transferred by said drive chain 256 to said drive sprocket 258 of said actuator and, ultimately, to drive sprocket 252 of drive rod 251.

At least one door drive chain 254 (not depicted in FIG. 8, but depicted in FIG. 4) is disposed around said at least one ancillary sprocket 253, and connected (typically at both ends of each door drive chain 254) to fluid containment door 200. Rotation of elongate drive rod 251 causes said at least one ancillary sprocket 253 to impart force to said at least one door drive chain 254 (not pictured in FIG. 8). In this manner, fluid containment door 200 can be selectively shifted from a first open/retracted position (wherein keyway opening 110 is fully open and unobstructed) to a second closed position (wherein keyway opening 110 is closed or substantially obstructed), and vice versa.

Although not depicted in the attached drawings, it is to be understood that in an alternative embodiment said powered actuator comprises at least one air-powered pneumatic cylinder disposed on the outer surface of said housing member. At least one flexible shaft (such as, for example, a substantially incompressible push/pull cable or the like) is slidably disposed in a curved track that extends from a piston rod of said at least one pneumatic cylinder to said at least one inner sleeve. Extension of said pneumatic cylinder can cause said flexible shaft to push said at least one fluid containment door to a closed or un-retracted position, while retraction of said pneumatic cylinder can cause said flexible shaft to pull said at least one fluid containment door to an open or retracted position.

Figure 9:
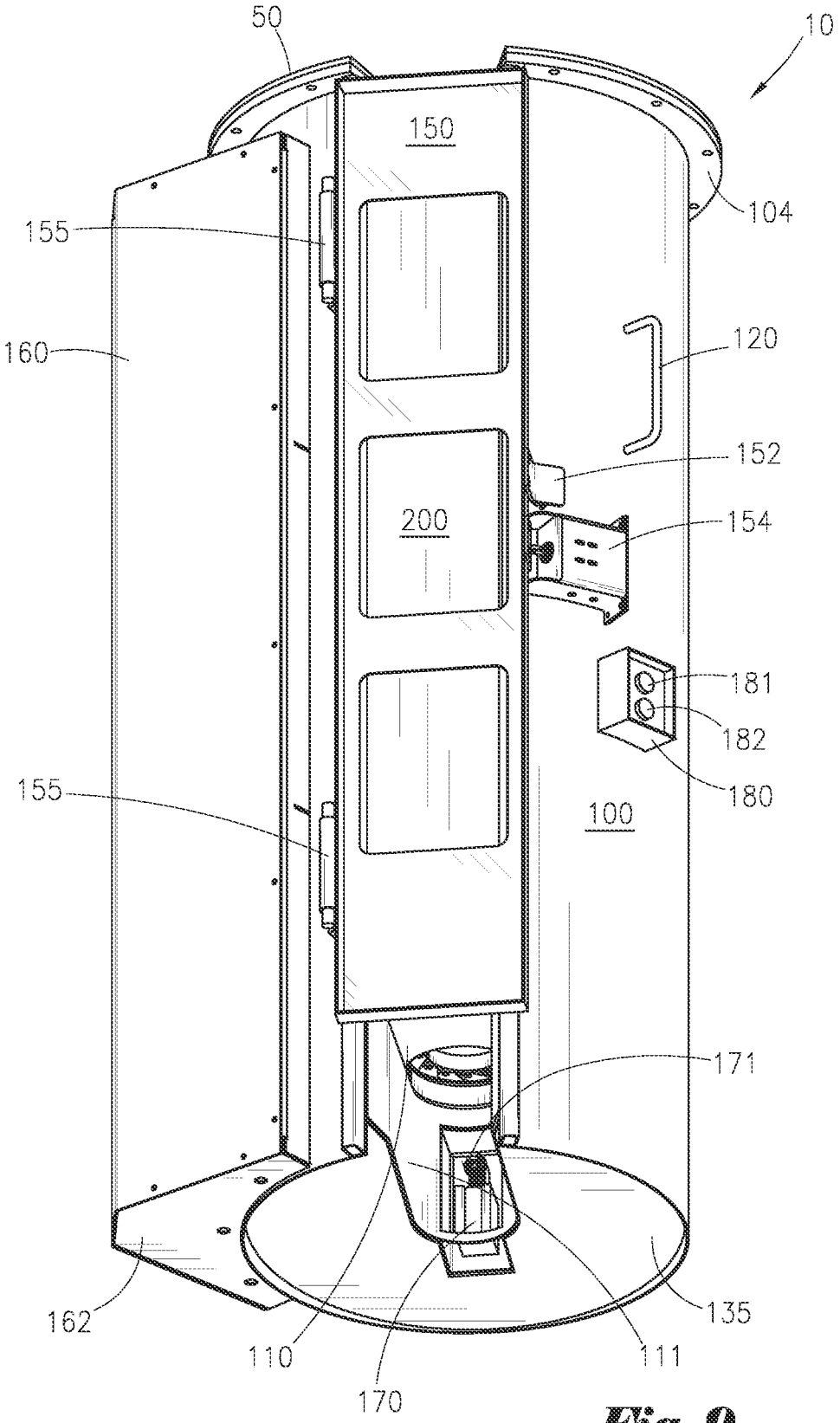
FIG. 9 depicts a bottom perspective view of the fluid containment apparatus of the present invention in a fully closed configuration.

FIG. 9 depicts a bottom perspective view of fluid containment apparatus 10 of the present invention in a fully closed configuration. As depicted in FIG. 9, actuator assembly cover 160 is installed along a lateral side of keyway opening 110 of housing 100. Fluid containment apparatus 10 generally comprises a substantially cylindrical housing or sleeve 100. Longitudinal keyway opening 110 is formed along the length of said housing 100, while cap 50 is removably attached to upper flange 104 of housing 100. At least one movable fluid containment door 200 is rotatably disposed within housing 100.

Manual gate or safety door 150 is hingedly attached to housing 100 in order to selectively block access to said keyway opening 110 of housing 100. In a preferred embodiment safety door 150 has at least one aperture or opening 151; mesh, screen or other substantially transparent material can be installed within said at least one aperture 151 to allow visual observation through said at least one aperture 151, while simultaneously preventing extremities (hands, fingers, arms, legs or feet) from passing through said at least one aperture 151. Further, safety door 150 can be connected to at least one switch or sensor 154 in order to sense when safety door 150 is or is not in a fully closed position (that is, not fully blocking keyway opening 110).

Still referring to FIG. 9, U-shaped guide 111 extends upward from base plate 135; said U-shaped guide 111 forms a channel or pathway from keyway opening 110 into housing 100 for accepting a pipe section. Said U-shaped guide 111 (and aligned U-shaped slot 54 of cap 50, depicted in FIG. 8) can receive a pipe section and act to align fluid containment apparatus 10 relative to said pipe section. In a preferred embodiment, a magnet 170 is disposed at or near the base (i.e., the inner most portion) of a channel formed by U-shaped guide 111. Said magnet 170 can be controlled with pressure switch 171; when a pipe section is received within said channel formed by said U-shaped guide 111, said switch 171 can be triggered, thereby causing magnet 170 to be activated. When so activated, magnet 170 (which is attracted to a metal pipe section) is activated, thereby cinching or pulling fluid containment apparatus 10 into abutting relationship with such a pipe section. A release switch can be provided for selective release of said magnet 170 from a pipe section.

Cap 50 is removably attached to upper flange 104. Further, said cap 50 includes eyelets for receiving shackles 53 which, in turn, can be used to connect fluid containment apparatus 10 to a hoist or other lifting device, thereby allowing said fluid containment apparatus 10 to be suspended within a drilling rig derrick or other location. Safety door 150 is hingedly attached to housing 100 in order to selectively block access to said keyway opening 110 of housing 100, particularly when said fluid containment door 200 is in a full or partially open position. Switch 154 senses when safety door 150 is in a fully closed position (that is, fully blocking keyway opening 110). Control panel 180 having "open" control button 181 and "close" control button 182, as well as handle member 120, can be disposed on the outer surface of housing 100.

When said at least one fluid containment door 200 is in a retracted or "open" position, said longitudinal keyway opening is not obstructed, and a pathway is established from outside said housing 100 through said keyway opening into the interior of said housing 100. However, when said at least one fluid containment door 200 is in an un-retracted or "closed" position, said at least one fluid containment door 200 blocks said keyway opening 110, thereby effectively sealing said keyway opening 110 of said housing member 100.

FIGS. 10 through 13 depict a sequential view of fluid containment apparatus 10 used in connection with adjoining pipe sections 400 and 401 and, more specifically, threaded connection members 400*a* and 401*a* thereof, which collectively cooperate to form a connection assembly commonly referred to as a "tool joint". In operation, said pipe sections 400 and 401 can be separated at said tool joint when removing a pipe string from a wellbore. In certain circumstances, mud or other drilling fluid contained within pipe section 400 can spill and spray radially outward (due to any hydrostatic head created by said drilling mud/fluid) when pipe threaded connection 400*a* is separated from threaded connection 401*a*.

Figure 10:
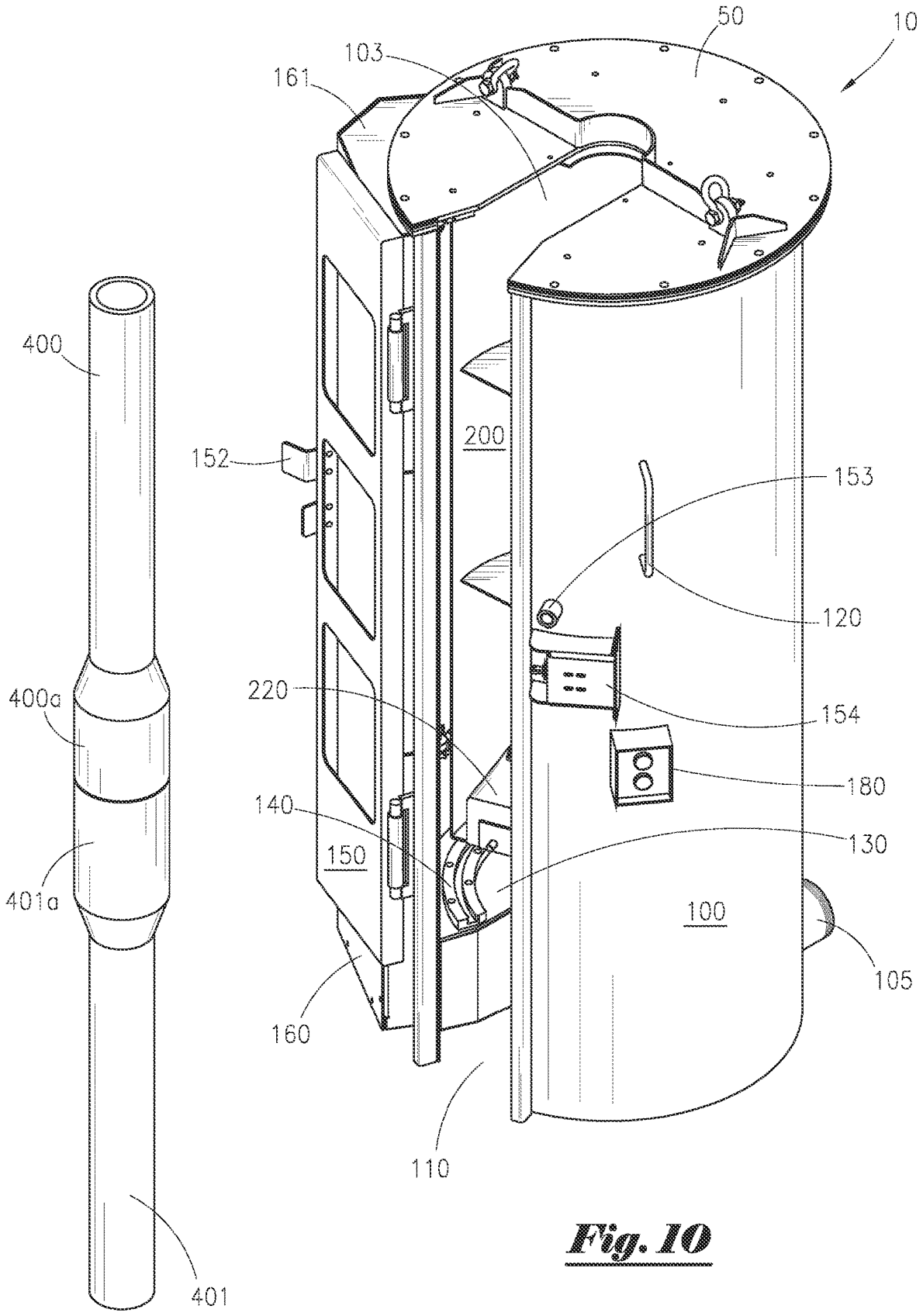
FIG. 10 depicts a side perspective view of the fluid containment apparatus of the present invention in a fully open configuration approaching connected pipe sections.

FIG. 10 depicts a side perspective view of the fluid containment apparatus 10 of the present invention in a fully open configuration approaching connected pipe sections 400 and 401. As depicted in FIG. 10, said fluid containment apparatus 10 can be hung or suspended within a drilling rig derrick, generally in proximity to where pipe sections extend from an upper portion of a well. Safety door 150 is in the open position, and mud containment door 200 is fully retracted. As such, keyway opening 110 is fully open and unobstructed, providing an open pathway for pipe sections 400 and 401 to be received within said keyway opening 110; fluid containment apparatus 10 can be moved or maneuvered (typically using handle(s) 120) until pipe section connection members 400*a* and 401*a* are received within inner chamber 103 of housing 100.

Figure 11:
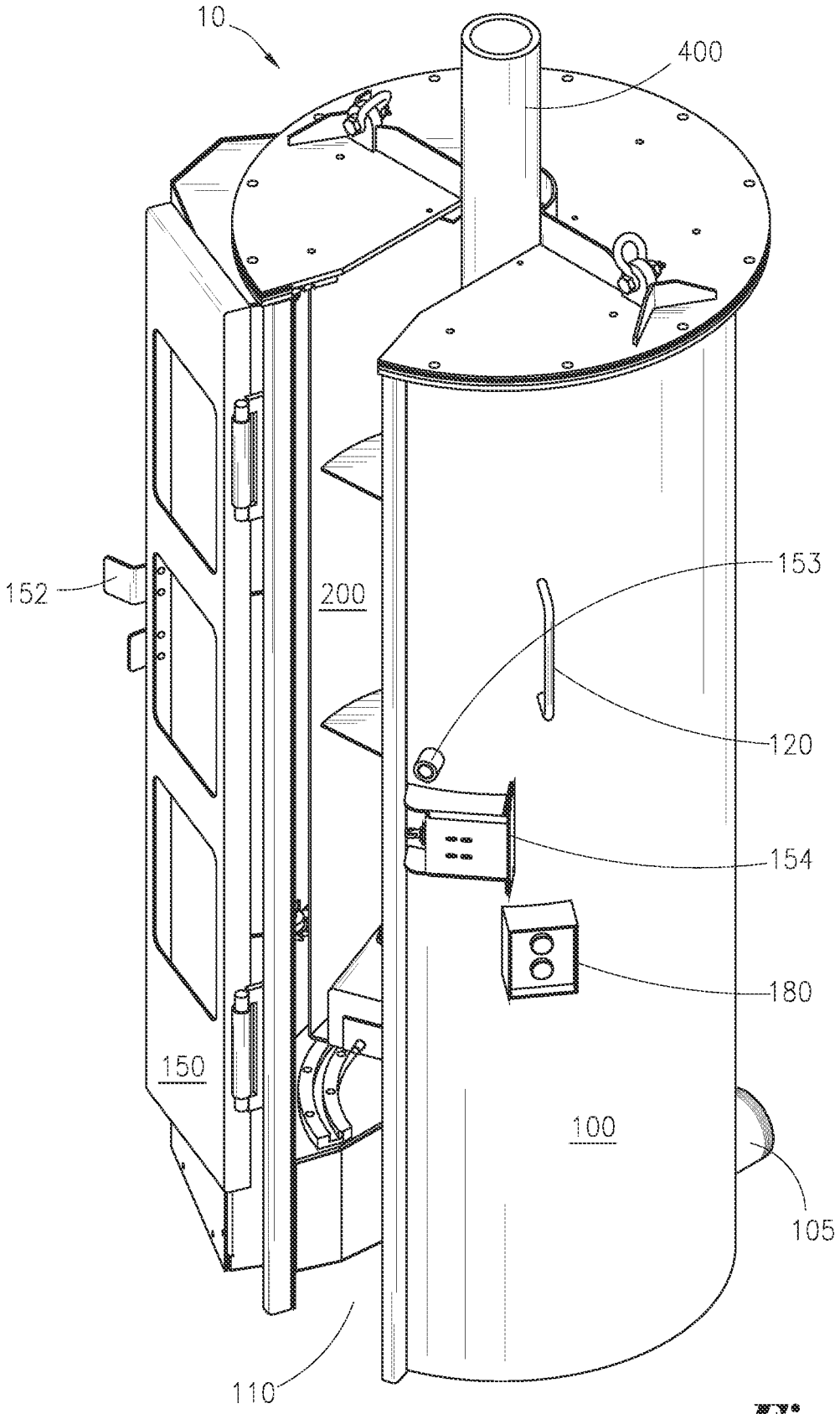
FIG. 11 depicts a side perspective view of the fluid containment apparatus of the present invention in a fully open configuration disposed around connected pipe sections.

FIG. 11 depicts a side perspective view of fluid containment apparatus 10 of the present invention in a fully open configuration disposed around connected pipe sections 400 and 401. As depicted in FIG. 11, safety door 150 is in the open position, and mud containment door 200 is fully retracted. As such, keyway opening 110 is fully open and unobstructed, providing an open pathway for pipe sections 400 and 401; as depicted in FIG. 11, pipe sections 400 and 401 are received within said keyway opening 110 and are disposed in inner chamber 103 of housing 100. Further, in this position it is to be observed that said pipe sections 400 and 401 are effectively centralized within said fluid containment apparatus 10. With safety door 150 in said open position, pneumatic switch 154 is not triggered, thereby blocking or preventing the supply of power fluid to an actuation assembly for containment door 200 and effectively preventing the accidental or inadvertent shifting or rotation of said containment door 200 within housing 100.

Figure 12:
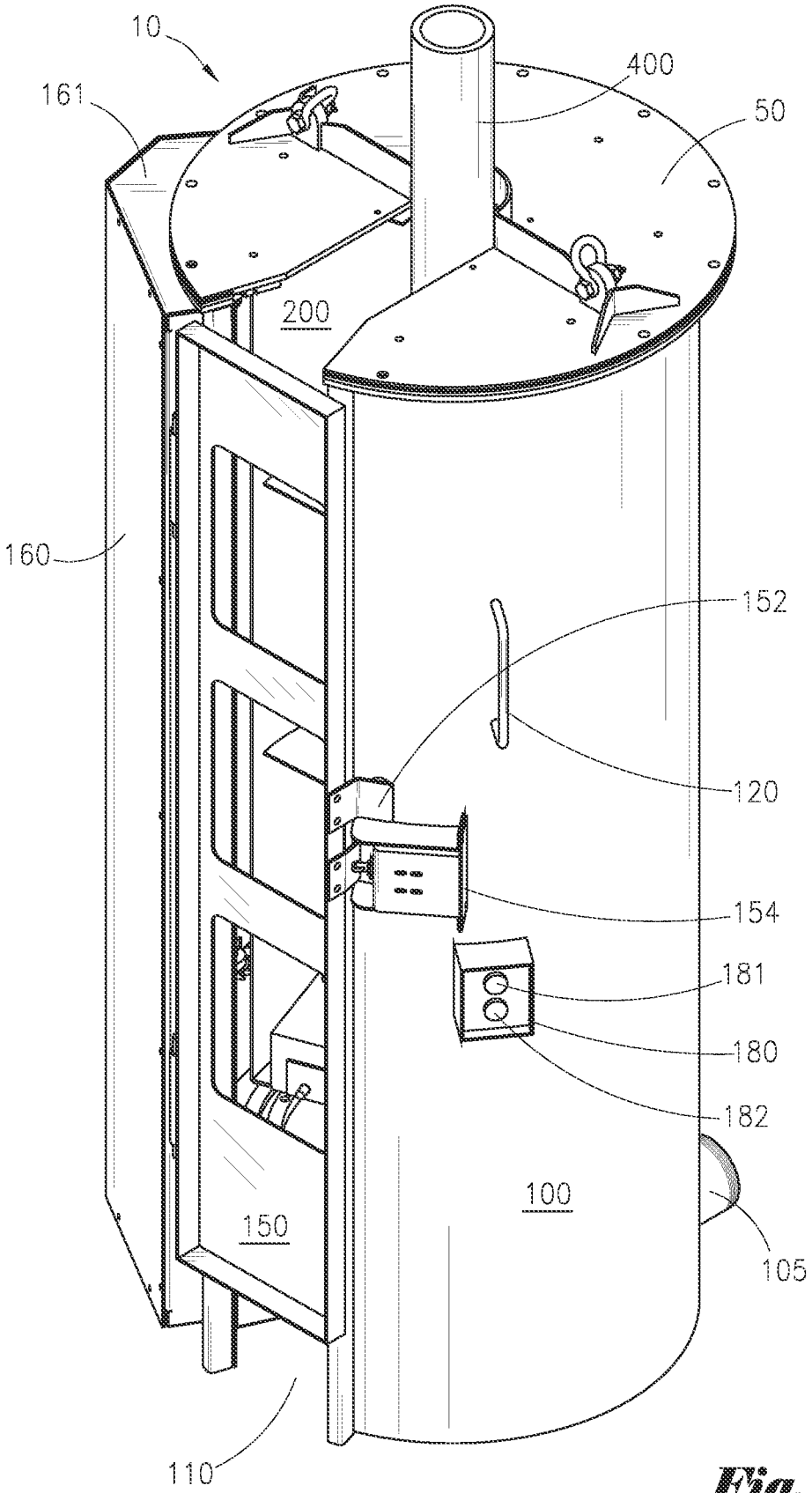
FIG. 12 depicts a side perspective view of the fluid containment apparatus of the present invention disposed around connected pipe sections with safety door in a closed position.

FIG. 12 depicts a side perspective view of fluid containment apparatus 10 of the present invention disposed around connected pipe sections 400 and 401, with safety door 150 in a closed and latched position. With safety door 150 in said closed position, pneumatic switch 154 is triggered, thereby opening the supply of power fluid (in this case, air) to a door actuation assembly (such as actuation assembly 190 depicted in FIG. 8, obscured from view in FIG. 12). In this position, keyway opening 110 cannot be accessed by a hand, foot or other body part of nearby personnel, because said closed safety door 150 is blocking said keyway opening 110. In this position, control panel 180 having "open" function button 181 and "close" function button 182 can be selectively actuated, thereby triggering functioning of said actuation assembly (such as actuation assembly 190 depicted in FIG. 8, not visible in FIG. 12) in order to shift fluid containment door 200 to a closed position.

Figure 13:
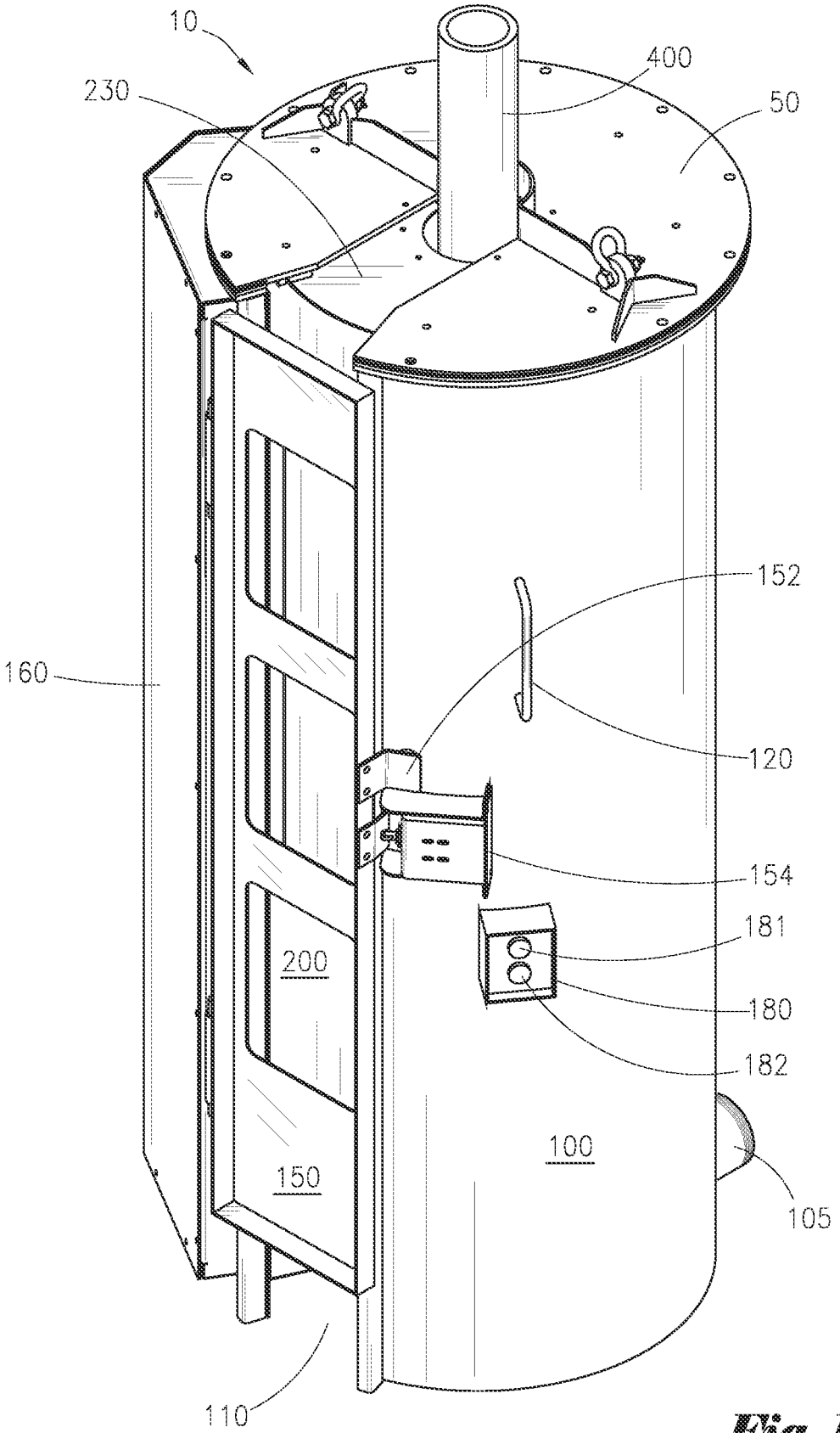
FIG. 13 depicts a side perspective view of the fluid containment apparatus of the present invention disposed around connected pipe sections with safety door and fluid containment door both in closed positions.

FIG. 13 depicts a side perspective view of fluid containment apparatus 10 of the present invention disposed around connected pipe sections 400 and 401 with safety door 150 closed and securely latched. Fluid containment door 200 has been shifted or rotated to a closed position. In this configuration, pipe section 400 can be rotated (unscrewed), separated from an adjacent pipe section and lifted, in order to move said pipe section 400 away from an adjacent pipe section (401, visible in FIG. 10). Upon such separation, any drilling mud or other fluid contained within the central through bore of pipe section 400 can spill or spray radially outward from said separated pipe section 400. However, any such mud or drilling fluid is contained and collected by fluid containment apparatus 10.

Figure 14:
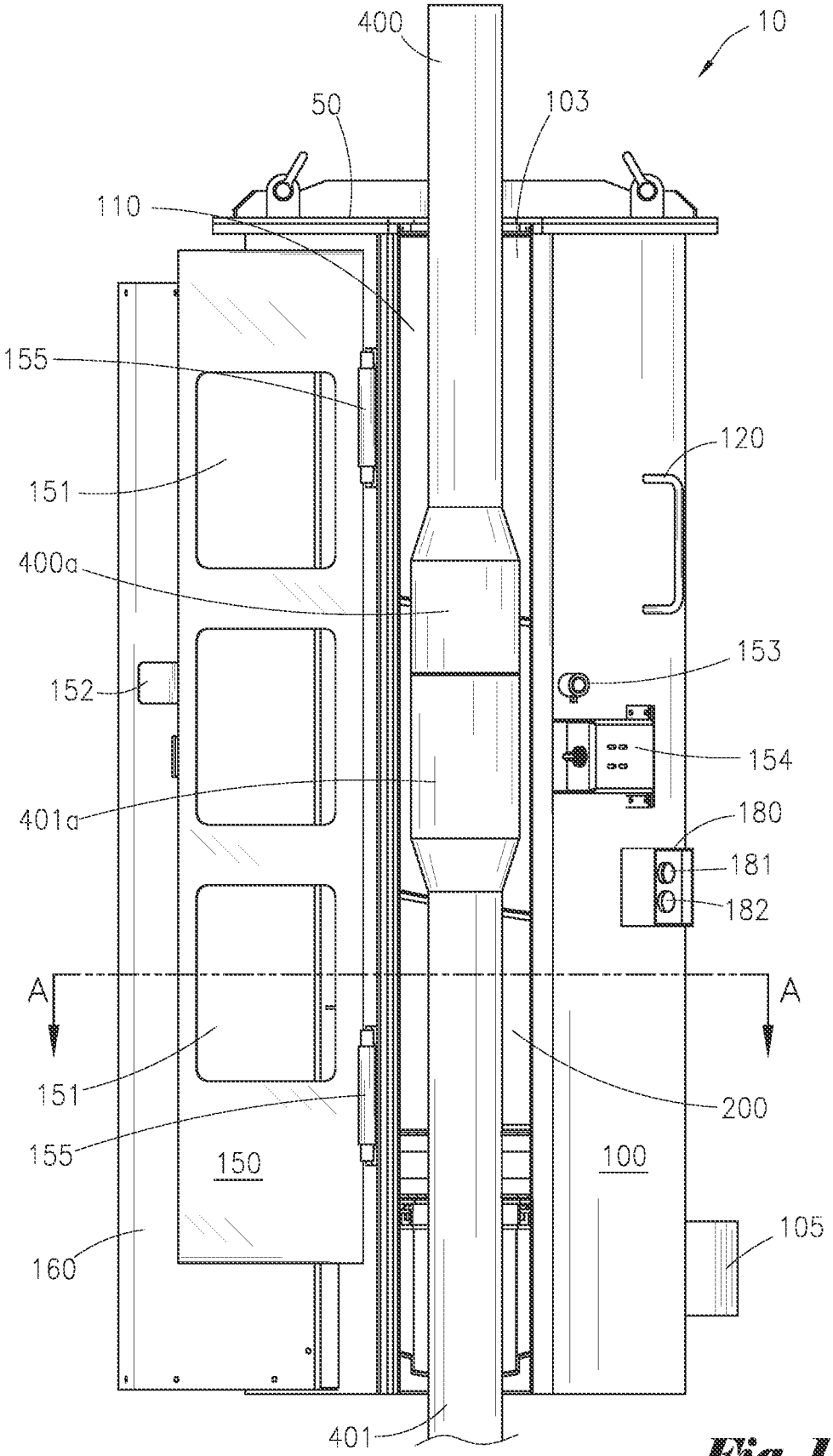
FIG. 14 depicts a side view of the fluid containment apparatus of the present invention in a fully open configuration disposed around connected pipe sections.

FIG. 14 depicts a side view of fluid containment apparatus 10 of the present invention in a fully open configuration disposed around connected pipe sections 400 and 401, which is essentially the same configuration as depicted in FIG. 11. As depicted in FIG. 14, safety door 150 is in the open position, and mud containment door 200 is fully retracted. Keyway opening 110 is fully open and unobstructed, providing an open pathway for pipe sections 400 and 401; as depicted in FIG. 14, pipe sections 400 and 401 are received within said keyway opening 110 and are disposed in inner chamber 103 of housing 100. Pipe sections 400 and 401 are effectively centralized within said fluid containment apparatus 10. With safety door 150 in said open position, pneumatic switch 154 is not triggered; as such, the supply of power fluid (in this case, air) is blocked to a powered actuation assembly controlling movement of containment door 200, and effectively preventing the accidental or inadvertent shifting or rotation of containment door 200 within housing 100.

Figure 15:
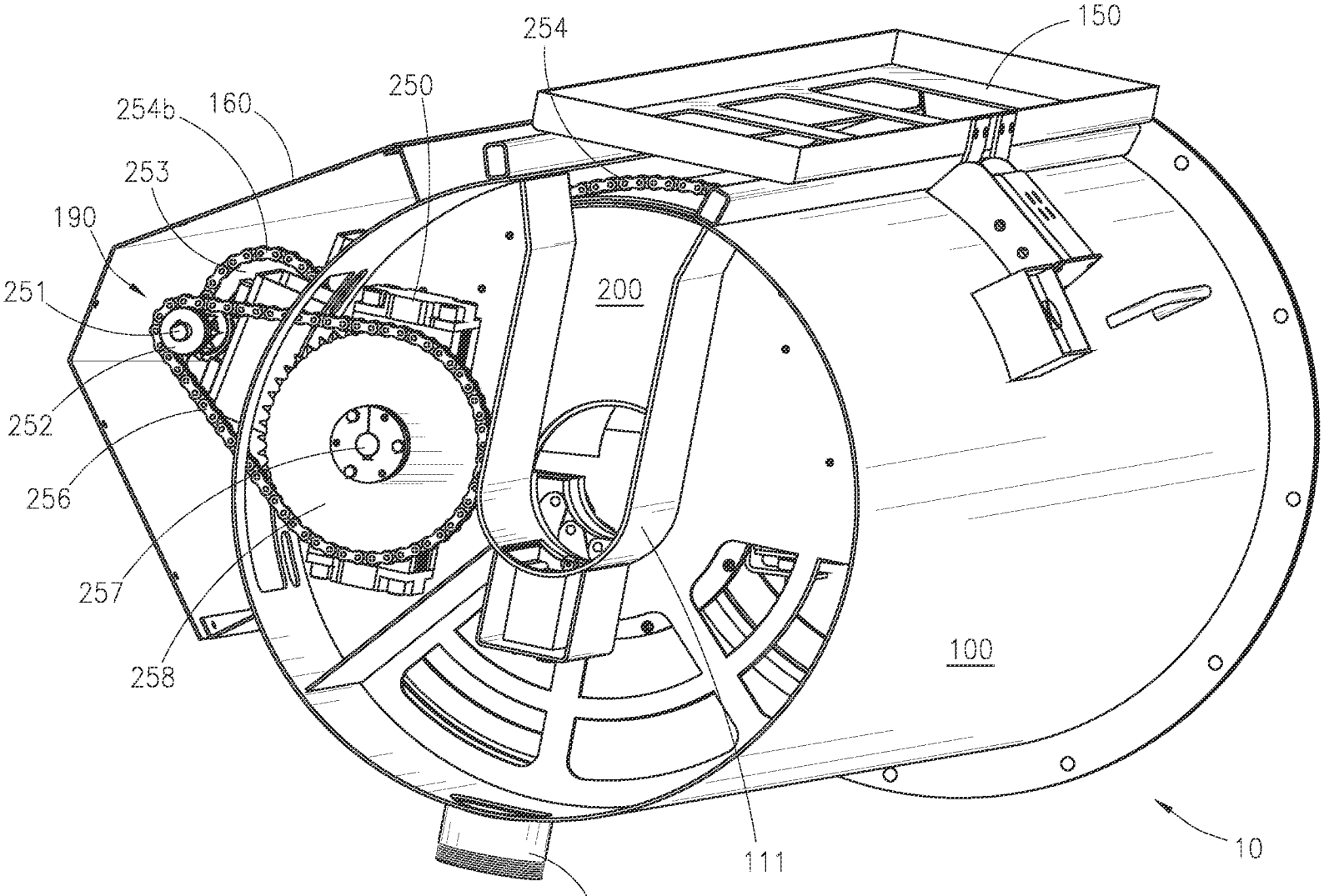
FIG. 15 depicts a bottom perspective view of the fluid containment apparatus of the present invention with base plate removed to expose a portion of the actuation assembly.

FIG. 15 depicts a bottom perspective view of fluid containment apparatus 10 of the present invention with cover 160 installed, and base plate (such as base 135 depicted in FIG. 9) removed to expose a portion of actuation assembly 190. At least one powered actuator 250 can be used to selectively shift said at least one fluid containment door 200 between a retracted position and an un-retracted position relative to said housing member 100. In a preferred embodiment, said powered actuator 250 comprises a pneumatically powered rotary actuator having an output power shaft 257; said output power shaft 257 is operationally attached to a drive sprocket 258. A drive rod 251 having a drive sprocket 252 and at least one ancillary sprocket 253 is rotationally mounted along the exterior of housing 100. Drive chain 256 extends around said actuator drive sprocket 258 and rod drive sprocket 252; as such, torque forces generated by said output power shaft 257 of said actuator 250 are transferred by said power shaft 257 to drive sprocket 258 and, ultimately, via drive chain 256 to drive sprocket 252 of drive rod 251.

At least one door drive chain 254 is disposed around said at least one ancillary sprocket 253, and connected (typically at both ends of each door drive chain 254) to fluid containment door 200. Actuation of said rotary actuator 250 transfers torque forces to said elongate drive rod 251 which, in turn, causes said at least one ancillary sprocket 253 to impart force to said at least one door drive chain 254. In this manner, fluid containment door 200 can be selectively shifted from a first open/retracted position (wherein keyway opening 110 is exposed and unobstructed) to a second closed position (wherein keyway opening 110 is closed or substantially obstructed), and vice versa.

FIG. 16 through FIG. 21 depict overhead sectional views of fluid containment apparatus 10 of the present invention disposed around connected pipe sections along line A-A of FIG. 14. More particularly, FIG. 16 through FIG. 21 depict sequential views of a variable-diameter seal assembly (comprising opposing and cooperating seal assemblies 300 and 301) that can selectively form a fluid pressure seal against the outer surface(s) of a pipe section disposed within said fluid containment apparatus.

Figure 16:
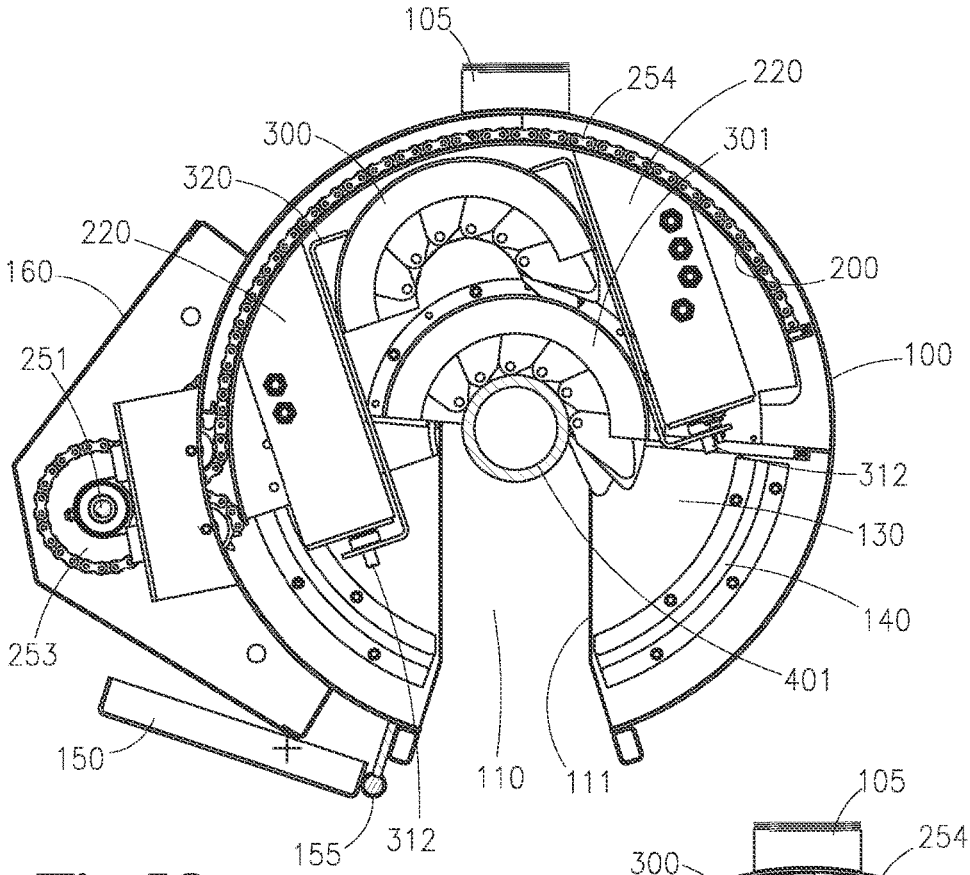
FIG. 16 depicts an overhead sectional view of the fluid containment apparatus of the present invention in a fully open configuration disposed around connected pipe sections along line A-A of FIG. 14.

FIG. 16 depicts an overhead sectional view of fluid containment apparatus 10 of the present invention disposed around connected pipe sections along line A-A of FIG. 14. (Drive chain 254 is not shown for clarity in FIG. 16) Lower pipe section 401 is received within keyway opening 110 and centrally positioned within U-shaped channel formed by guide member 111 within the chamber of housing 100. Fluid containment door 200 is in a fully retracted or open position, and hinged safety door 150 is likewise in an open (and secured) position. Because safety door 150 is not fully closed, the supply of operating power fluid (air, in a preferred embodiment) is blocked to a powered actuator (such as actuator 250 depicted in FIG. 15) or other functional component of actuator assembly 190, thereby preventing fluid containment door 200 from inadvertently shifting or rotating, especially to a closed position.

In the configuration depicted in FIG. 16, piston rods 312 are fully retracted, thereby causing seal carrier yoke 320 and movable variable seal assembly 300 to also be fully retracted. In this position, containment door 200 can rotate, traveling along curved track 140 on base 130 without contact or interference between movable variable seal assembly 300 and stationary variable seal assembly 301.

Figure 17:
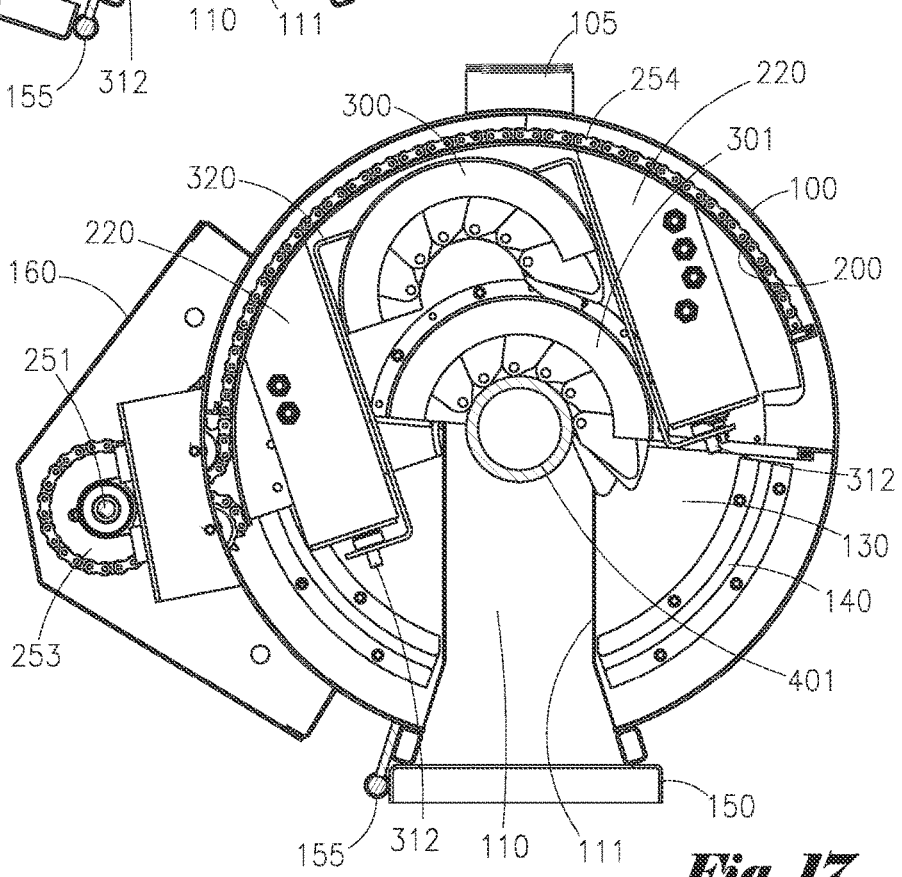
FIG. 17 depicts an overhead sectional view of the fluid containment apparatus of the present invention, as depicted in FIG. 16, but with the safety door in a closed and latched position.

FIG. 17 depicts an overhead sectional view of fluid containment apparatus 10, as depicted in FIG. 16, but with safety door 150 in a closed and latched position. (Drive chain 254 is not shown for clarity in FIG. 17) As depicted in FIG. 17, fluid containment door 200 remains in a fully retracted or open position. However, safety door 150 blocks access to keyway opening 110 and said U-shaped channel formed by guide member 111 from the outside of fluid containment apparatus 10, thereby preventing personnel from inadvertently placing hands, fingers or other body parts or extremities within said keyway opening 110. Further, because safety door 150 is closed, a switch (such as switch 154 depicted in FIG. 14) can be triggered, permitting the supply of operating power fluid (air, in a preferred embodiment) to a powered actuator (such as actuator 250 depicted in FIG. 15) or other functional component of actuator assembly 190.

Figure 18:
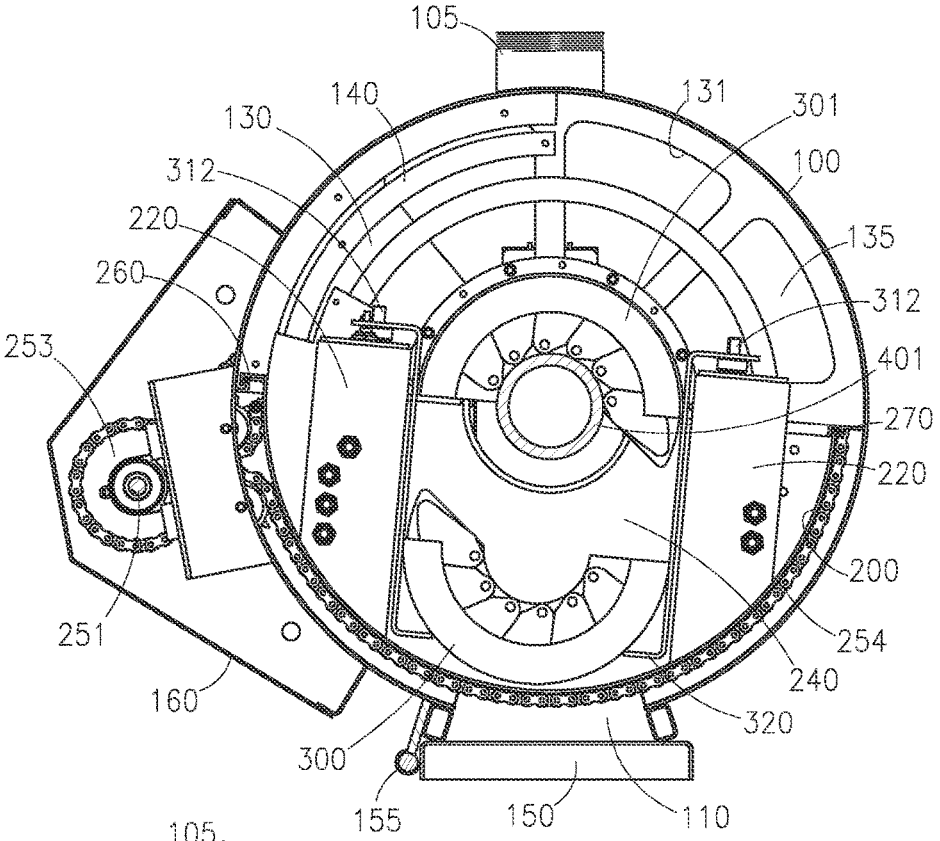
FIG. 18 depicts an overhead sectional view of the fluid containment apparatus of the present invention, as depicted in FIG. 17, but with the fluid containment door in a closed position.

FIG. 18 depicts an overhead sectional view of fluid containment apparatus 10, as depicted in FIG. 17, but with said fluid containment door 200 shifted or rotated to a closed position. (Drive chain 254 is not shown for clarity in FIG. 18) In this position, actuation assembly 190 has functioned, causing fluid containment door 200 to travel along curved track 140, obscured from view in FIG. 18 by visible in FIG. 17. In this configuration, it is to be observed that housing 100 and fluid containment door 200 cooperate to substantially surround pipe section(s) contained within fluid containment apparatus 10.

In the configuration depicted in FIG. 18, rotation of containment door 200 exposes apertures 131 extending through door support base 130. Said apertures extend to a sump area or space formed between door support base 130 and lowermost base plate 135 (also depicted in FIG. 9). Fluid drain or outlet port 105 extends from said sump area or space formed between door support base 130 and lowermost base plate 135, and the outside of housing 100. The diameter and fittings of said outlet port 105 can be adjusted to meet particular operational criteria; in a preferred embodiment, a conventional hose or conduit (not depicted) can be attached to said outlet port 105 to permit fluid collecting in said sump area or space to drain out of said outlet port 105 and through said hose or conduit to a rig's mud tanks or other location for collection and/or further handling.

Still referring to FIG. 18, it is to be observed that piston rods 312 are fully retracted, thereby causing seal carrier yoke 320 and movable variable seal assembly 300 to also be fully retracted. In this position, movable variable seal assembly 300 is positioned in the space formed between actuator housings 220. Further, variable seal assembly 300 is brought into opposing linear alignment with stationary variable seal assembly 301.

Figure 19:
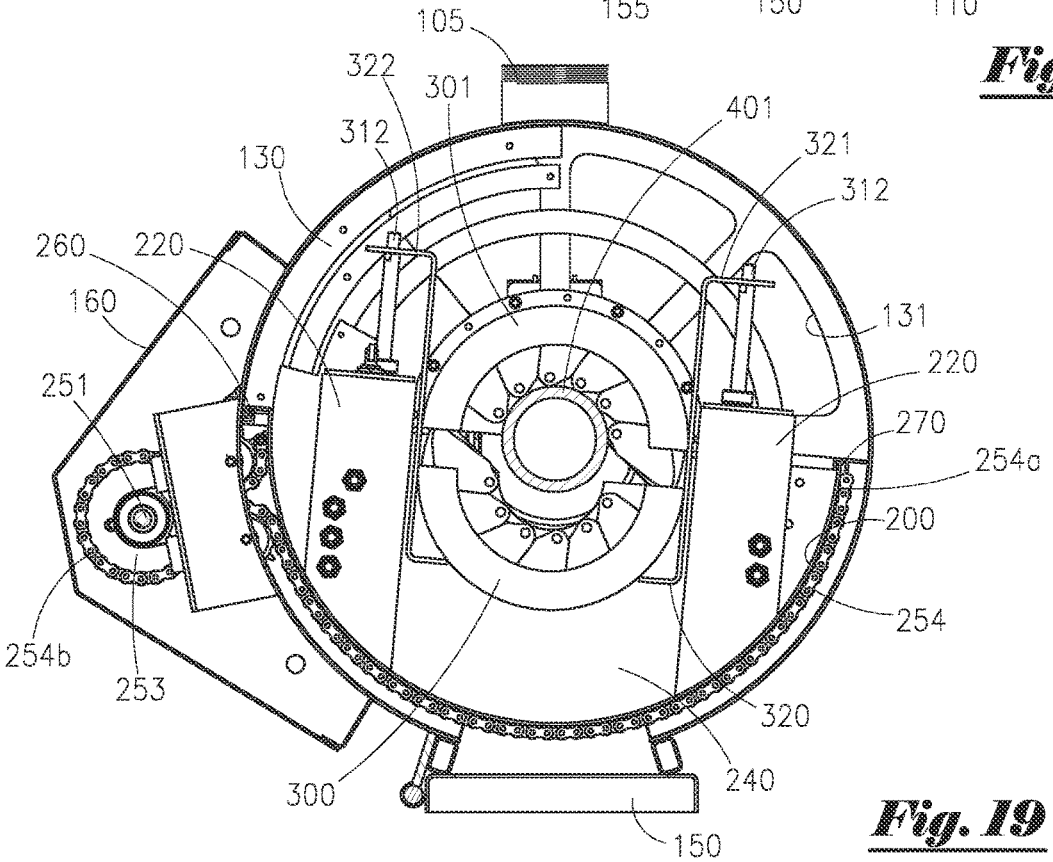
FIG. 19 depicts an overhead sectional view of the fluid containment apparatus of the present invention, as depicted in FIG. 18, with the movable variable seal assembly approaching said pipe.

FIG. 19 depicts an overhead sectional view of fluid containment apparatus 10, as depicted in FIG. 18, but with piston rods 312 partially extended. In this configuration, piston rods 312 are shown partially extended. Extension of said piston rods 312 causes seal carrier yoke 320 and attached movable variable seal assembly 300 to move along base 240 of containment door 200. More specifically, extension of said piston rods 312 causes seal carrier yoke 320 and attached movable variable seal assembly 300 to move linearly toward pipe section 401 and stationary variable seal assembly 301.

Figure 20:
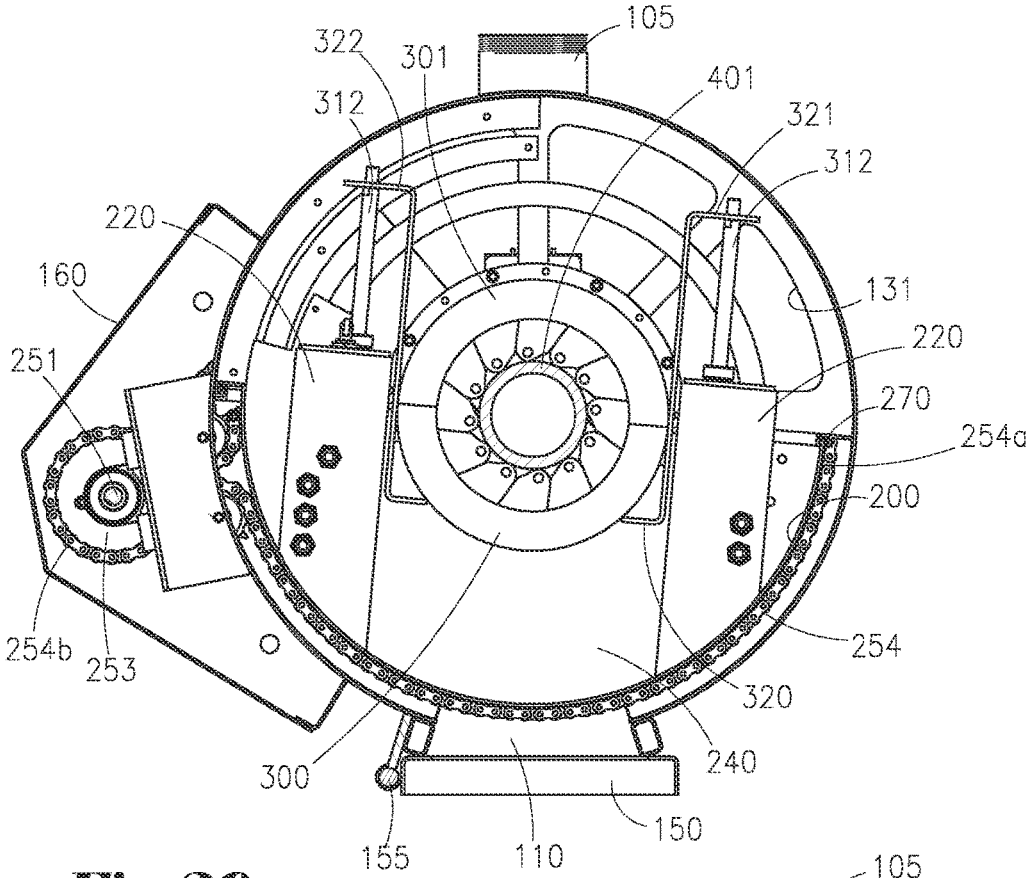
FIG. 20 depicts an overhead sectional view of the fluid containment apparatus of the present invention, as depicted in FIG. 19, with the movable variable seal assembly forming a fluid pressure seal against the external surface of said pipe.

FIG. 20 depicts an overhead sectional view of fluid containment apparatus 10, as depicted in FIG. 19, but with the movable variable seal assembly forming a fluid pressure seal against the external surface of said pipe 401. In this configuration, piston rods 312 are shown extended. Continued extension of said piston rods 312 causes seal carrier yoke 320 and attached movable variable seal assembly 300 to move along base 240 of containment door 200. More specifically, extension of said piston rods 312 causes movable variable seal assembly 300 to move linearly toward, and ultimately into contact with, pipe section 401 and stationary variable seal assembly 301.

Figure 21:
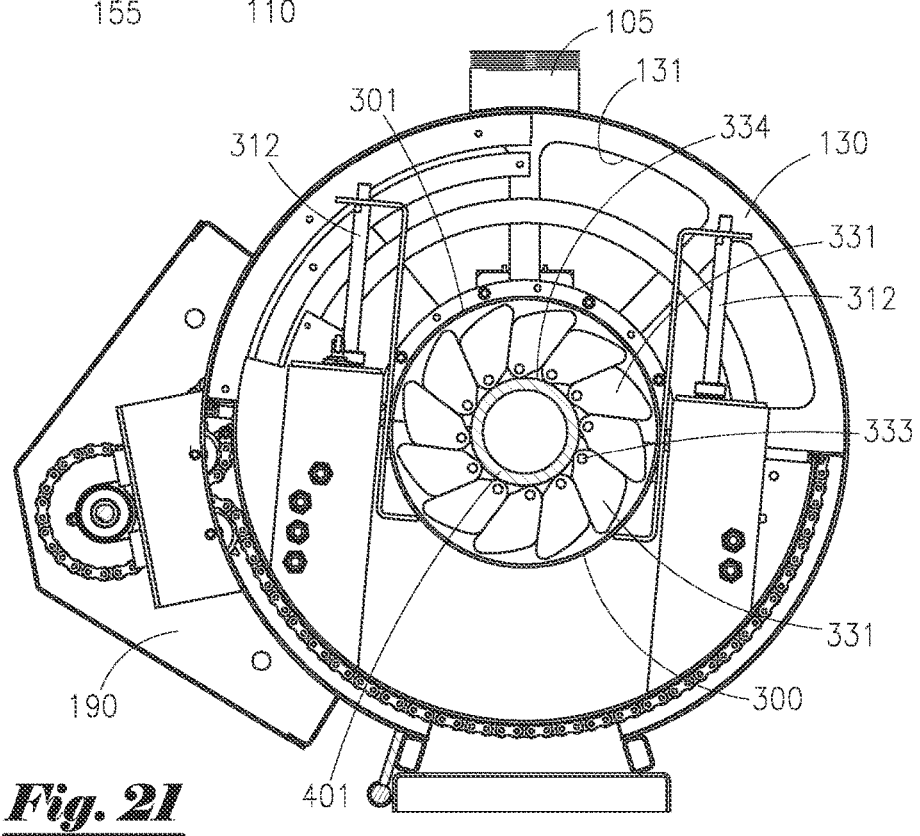
FIG. 21 depicts the view depicted in FIG. 20, with a partial cut away view of the variable pipe seal assemblies.

FIG. 21 depicts a partial cut away view of the configuration depicted in FIG. 20, with the upper portions of opposing seal carriers 330 removed from movable variable seal assembly 300 and stationary variable seal assembly 301. As upper variable seal members 331 of movable variable seal assembly 300 and stationary variable seal assembly 301 (and attached lower variable seal members 332, obscured from view in FIG. 21) are joined in opposing relationship, said variable seal member members 331 and 332 (obscured from view in FIG. 21) contact one another. Further, as linear force is applied to movable seal assembly 300 by piston rods 312, such linear force is transferred to said variable seal members 331 and 332 (obscured from view in FIG. 21).

Said variable seal members 331 and 332 are restrained against outward radial movement by opposing seal carriers 330 and, therefore, will cooperate to slide against each other (that is, each pair of joined seal members 331 and 332 will slide against an immediately adjoining pair of joined seal members 331 and 332). As said seal member pairs slide against each other, the tapered wedge-like shape of said variable seal members cause connector rods 333 converge in a generally radially inward direction, thereby converging in a radially inward direction toward the outer surface of pipe section 401. Elastomeric sealing member 334 "follows" movement of said connector rods 333, eventually uniformly contacting substantially the entire out circumferential diameter of pipe section 401. Typically, opposing seal carriers will not meet or touch each other, except perhaps when variable seal assembly 300 and stationary variable seal assembly 301 cooperate to form a seal against the smallest size pipe in a pipe diameter size range.

In this manner, movable variable seal assembly 300 and stationary variable seal assembly 301 cooperate to form a fluid pressure seal around the outer circumferential surface of pipe section 401. As more opposing linear force is applied to said variable seal assemblies (via extension of piston rods 312), the more restrictive the radial seal that is formed against pipe section 401 by said cooperating variable seal assemblies. Accordingly, said movable variable seal assembly 300 and stationary variable seal assembly 301 can cooperate to form a fluid pressure seal against a wide range of different sizes of pipe having different outer diameter dimensions; by way of illustration, said variable seal assemblies can cooperate to form a seal against any pipe in the range of 3.5" to 5.5" OD (or such other range of outer diameters as may be desired). As such, neither said movable variable seal assembly 300 nor said stationary variable seal assembly 301 must be removed or replaced (and rig pipe operations are not required to cease) in order to seal against different sizes of pipe.

As discussed herein, opposing movable variable seal assembly 300 and stationary variable seal assembly 301 are shown only along base 240 of fluid containment door 200. However, it is to be observed that a substantially similar configuration can also be employed to provide a variable external seal against the outer surface of upper pipe section 400 by installing the components and methods disclosed herein to the underside of top 230 of said containment door 200.

In the configuration depicted in FIG. 21, said housing member 10, cap 50, said at least one fluid containment door 200, and variable seal assemblies 300 and 301 cooperate to effectively surround a threaded pipe connection contained therein. Adjoining sections of pipe can be separated (typically by lifting of an upper pipe section away from a lower pipe section); during such separation, fluid containment apparatus 10 contains, diverts and saves drilling fluid in the inner chamber thereof, thereby preventing drilling fluid from uncontrolled spraying, splashing or spilling on a nearby rig floor, personnel and/or surrounding environment. Any fluids released within the inner chamber of said fluid containment apparatus 10 that splash on said baffle member(s) can be directed toward apertures 131, but will not be released outside of said fluid containment apparatus 130 (except in a controlled manner through fluid outlet 105).

Thereafter, with safety door 150 still in a closed position, operating power fluid remains supplied to an actuation assembly 190, thereby allowing said at least one fluid containment door 200 to be selectively shifted back to said a first open position. Said safety door 150 can then be opened, again blocking the supply of operating power fluid to said actuation device. In this configuration (with safety door 150 in the open position and operating power fluid blocked), actuation assembly 190 will not operate and the at least one fluid containment door 200 cannot be inadvertently or accidentally closed. With said at least fluid containment door 200 (and safety door 150) open, said fluid containment apparatus can be quickly and efficiently moved away from the separated pipe section to a stand-by position. Thereafter, the process can be repeated.

In a preferred embodiment, fluid containment apparatus 10 (and, more particularly, rotary actuator 250 and linear actuators 310) are pneumatically operated and are supplied with operating fluid (air) from a conventional drilling rig air supply. Notwithstanding the foregoing, hydraulically or electrically powered actuators can be utilized without departing from the scope of the present invention. Further, in a preferred embodiment, said power fluid (typically air) can be routed through a system of conduits, switches and/or relays to control sequential operation (and locking out of certain components) of fluid containment apparatus 10.

More specifically, as discussed above, air supply is selectively blocked from rotary actuator 250 unless safety door 150 is closed, and safety door switch 154 is triggered. With said safety door 150 closed and said switch 154 triggered, air is only then provided to actuator 250. In this configuration, "close" button 182 on control panel 180 can be actuated, thereby causing actuation of actuator 250 and rotation of fluid containment door 200. An optional containment door switch can be provided to recognize full closure of said fluid containment door 200 (such as, for example, a pressure switch located at the terminus of said rotation that is contacted by leading edge 270 of fluid containment door 200); triggering of said containment door switch cuts air supply to actuator 250, while routing the supply of air to cylinders 310.

With said fluid containment door 200 fully closed and air supplied to cylinders 310, movable variable seal assembly 300 can be linearly moved into contact with stationary variable seal assembly 301, thereby forming a fluid pressure seal around the outer circumferential surface of pipe section 401. In this manner it is to be observed that said cylinders 310 will not inadvertently function or cause movement of variable seal assembly 300 until after fluid containment door 200 is fully rotated to a closed position and said fluid containment door switch is triggered.

After drilling fluid/mud has been evacuated from separated pipe sections within fluid containment apparatus 10, "open" button 181 on control panel 180 can be selectively actuated, thereby causing fluid powered cylinders 310 to retract (with supply of fluid to rotary actuator 250 still blocked or locked out). Retraction of said cylinders 310 causes movable variable seal assembly 300 to be linearly moved away from stationary variable seal assembly 301 and the outer circumferential surface of pipe section 401. Retraction of cylinders 310 and attached seal carrier yoke 320 causes flange member 322 (and, more specifically, extended flange section 322*a*) to trigger pressure switch 350 (see, for example, FIG. 5).

Triggering of pressure switch 350 cuts off air supply to cylinders 310, while supplying air to rotary actuator 250, thereby causing rotation of fluid containment door 200 back to an open position. In this manner it is to be observed that said actuator 250 will not inadvertently function or cause rotation of fluid containment door 200 until and unless variable seal assembly 300 is fully retracted and switch 350 is triggered (temporarily disabling or locking out said cylinders 310). Thereafter, safety door 150 can be opened, magnet 170 can be released from a pipe section, and the process can be repeated.

Fluid containment apparatus 10 may also include a hardware processor and memory that can control various functions and/or logic of the apparatus, including those steps set forth above. The processor may be a microprocessor, central processing unit (CPU), or other types of circuitry. The memory may include volatile memory and non-volatile memory, and other types of memory. The memory may store code (e.g., instructions, logic, etc.) executed by the processor in the control of fluid containment apparatus 10. In some examples, the processor and memory may be collectively referred to as a controller or computing system. The computing system may include an integrated circuit, a printed circuit board (PCB), a printed circuit assembly (PCA) or printed circuit board assembly (PCBA), an application-specific integrated circuit (ASIC), a programmable logic controller (PLC), a component of a distributed control system (DCS), a field-programmable gate array (FPGA), or other types of circuitry. Firmware may be employed. In some cases, firmware if employed may be code embedded on the controller such as programmed into, for example, read-only memory (ROM) or flash memory. Firmware may be instructions or logic for the controller hardware and may facilitate control, monitoring, data manipulation, and so on, by the controller.

Thus, the present invention is significantly smaller, lighter and safer than conventional hinged mud buckets. Unlike said conventional hinged mud buckets, the apparatus of the present invention cannot be inadvertently or accidentally closed (including, on a body part of nearby personnel). Further, apparatus of the present invention is significantly easier to maneuver and position, and contains more fluids, than conventional hinged mud buckets.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A fluid containment apparatus comprising:

a) a substantially cylindrical outer housing having a top, a bottom, an inner space and an elongated slot extending from said top to said bottom;

b) an inner door member slidably disposed within said housing, wherein said inner door member is configured to alternate between a first position wherein said elongated slot is substantially unobstructed, and a second position wherein said inner door member substantially obstructs said elongated slot;

c) an actuation assembly configured to selectively move said inner door member between said first and second positions; and d) a safety door hingedly attached to said housing, wherein said safety door is configured to selectively alternate between a first safety door position wherein said elongated slot is substantially unobstructed, and a second safety door position wherein said safety door substantially blocks said elongated slot and provides a barrier for preventing a body part from contacting said inner door during movement of said inner door between said first and second positions.

2. The fluid containment apparatus of claim 1, wherein said actuation assembly is prevented from moving said inner door unless said safety door is in said second safety door position.

3. The fluid containment apparatus of claim 1, further comprising a pipe seal assembly configured to form a fluid pressure seal around the outer surface of a pipe section disposed within said housing.

4. The fluid containment apparatus of claim 3, wherein said pipe seal assembly is configured to variably seal around pipes having outer diameter sizes falling within a predetermined range of outer diameter sizes.

5. The fluid containment apparatus of claim 3, further comprising:

a) a first pipe seal member comprising:

i) a first semi-circular seal housing defining a first concave surface;

ii) a first plurality of substantially wedge-shaped members movably disposed along said first concave surface of said first semi-circular housing;

iii) an elastomeric member operationally attached to said first plurality of wedge-shaped members;

b) a second pipe seal member comprising:

i) a second semi-circular seal housing defining a second concave surface, wherein said second concave surface is oriented in opposing linear relationship to said first concave surface;

ii) a second plurality of substantially wedge-shaped members movably disposed in said first semi-circular housing; and iii) an elastomeric member operationally attached to said second plurality of wedge-shaped members.

6. The fluid containment apparatus of claim 5, wherein said first and second pluralities of substantially wedge-shaped members cooperate to radially converge around the outer surface of a pipe section disposed between said first and second pipe seal members.

7. The fluid containment apparatus of claim 6, further comprising at least one linear actuator configured to move said first pipe seal member toward said second pipe seal member.

8. A method for containing and collecting fluids expelled during the separation of adjoining pipe sections comprising:

a) providing a fluid containment apparatus comprising:

i) a substantially cylindrical outer housing having a top, a bottom, an inner space and an elongated slot extending from said top to said bottom;

ii) an inner door member slidably disposed within said housing, wherein said inner door member is configured to alternate between a first position wherein said elongated slot is substantially unobstructed, and a second position wherein said inner door member substantially obstructs said elongated slot;

iii) an actuation assembly configured to selectively move said inner door member between said first and second positions;

iv) a safety door operationally attached to said housing, wherein said safety door is configured to selectively alternate between a first open safety door position wherein said elongated slot is substantially unobstructed, and a second closed safety door position wherein said safety door substantially obstructs said elongated slot and provides a barrier for preventing a body part from contacting said inner door during movement of said inner door between said first and second positions;

b) maneuvering said fluid containment apparatus around said adjoining pipe sections, wherein said adjoining pipe sections pass through said elongated slot;

c) moving said inner door member to said second position; and d) separating said adjoining pipe sections.

9. The method of claim 8, wherein said actuation assembly is prevented from moving said inner door unless said safety door is in said second safety door position.

10. The method of claim 8, further comprising a pipe seal assembly configured to form a fluid pressure seal around the outer surface of a pipe section disposed within said housing.

11. The method of claim 10, further comprising:

a) a first pipe seal member comprising:

i) a first semi-circular seal housing defining a first concave surface;

ii) a first plurality of substantially wedge-shaped members movably disposed along said first concave surface of said first semi-circular housing;

iii) an elastomeric member operationally attached to said first plurality of wedge-shaped members;

b) a second pipe seal member comprising:

i) a second semi-circular seal housing defining a second concave surface, wherein said second concave surface is oriented in opposing linear relationship to said first concave surface;

ii) a second plurality of substantially wedge-shaped members movably disposed in said first semi-circular housing; and iii) an elastomeric member operationally attached to said second plurality of wedge-shaped members.

12. The method of claim 11, further comprising moving said first and second seal members toward each other.

13. The method of claim 12, wherein said first and second pluralities of substantially wedge-shaped members cooperate to radially constrict around the outer surface of a pipe section disposed between said first and second pipe seal assemblies.

* * * * *